US012735893B1

(12) United States Patent
Clark

(10) Patent No.: US 12,735,893 B1
(45) Date of Patent: Sep. 15, 2026

(54) STRUCTURAL SHEAR TIE CONNECTOR FOR SANDWICHED INSULATED CONCRETE AND SANDWICHED INSULATED CONCRETE WALLS/PANELS

(71) Applicant: Timothy L. Clark, Georgetown, TX (US)

(72) Inventor: Timothy L. Clark, Georgetown, TX (US)

( * ) Notice: Subject to any disclaimer, the term of this patent is extended or adjusted under 35 U.S.C. 154(b) by 0 days.

(21) Appl. No.: 19/385,643

(22) Filed: Nov. 11, 2025

Related U.S. Application Data

(60) Provisional application No. 63/795,573, filed on Apr. 27, 2025.

(51) Int. Cl.
*E04C 5/07* (2006.01)
*E04C 2/288* (2006.01)

(52) U.S. Cl.
CPC ..... *E04C 5/073* (2013.01); *E04C 2/288* (2013.01)

(58) Field of Classification Search
CPC ..... E04C 5/073; E04C 2/288
See application file for complete search history.

(56) References Cited

U.S. PATENT DOCUMENTS 4,117,639 A 10/1978 Steenson et al.
4,640,074 A 2/1987 Paakkien
4,730,422 A * 3/1988 Young ..... E04B 1/86 52/562
5,119,614 A * 6/1992 Rex ..... E04C 3/34 52/649.3
5,653,414 A * 8/1997 Chimel ..... G02C 11/00 248/902
6,308,484 B1 * 10/2001 Severino ..... E04B 2/8652 52/426
9,303,404 B2 4/2016 Naito et al.
9,540,775 B2 * 1/2017 Heady ..... E04C 5/20
10,870,988 B2 * 12/2020 Keith ..... E04C 2/288
2004/0148674 A1 * 8/2004 Simmons, Sr. ..... G02C 7/16 2/13
2013/0326980 A1 * 12/2013 Hilliard, Sr. ..... E04B 2/8635 52/309.1

FOREIGN PATENT DOCUMENTS

CA 2209251 C * 10/2001 ..... E04B 2/8617
WO WO-2024069515 A1 * 4/2024 ..... E04B 1/04

OTHER PUBLICATIONS https://cortartec.net/en/products/structures/shear-load-connectors/.
https://www.mdpi.com/2075-5309/12/9/1429.

* cited by examiner

*Primary Examiner* — Babajide A Demuren
(74) *Attorney, Agent, or Firm* — Edison Law Group, PLLC

(57) ABSTRACT

A shear tie and methods of manufacture disclosed herein incorporate the structural configuration requirements with the incorporation of high-strength, low thermal-conducting properties of fiberglass/carbon fiber/synthetic polymer fiber to meet both structural and thermal requirements. The structural shear tie connectors disclosed herein may collect and resist superimposed loads/forces between the concrete wythes, which results in structural control of longitudinal bending within a panel. With a more efficient/stronger structural connector, fewer connectors are required to resist an equal superimposed load(s), and/or yielding higher-level composite load resisting result(s). Further, the shear tie disclosed herein allows increased strength and stiffness in a thinner connector, which may provide lower thermal conductivity than known heretofore.

22 Claims, 12 Drawing Sheets

FIG. 6
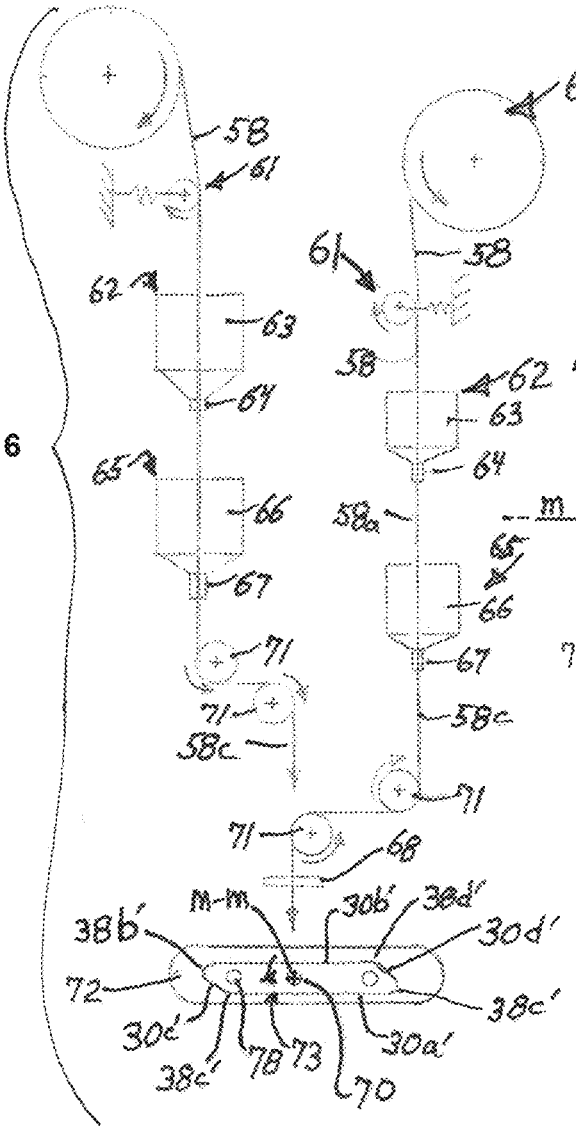
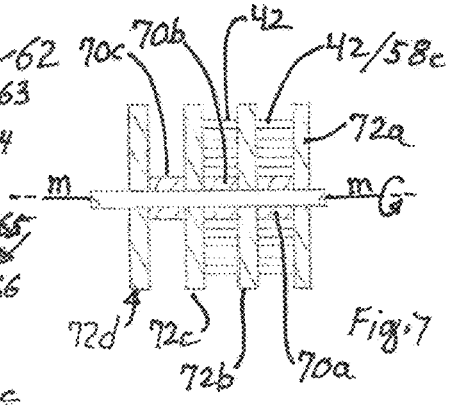
Fig. 7
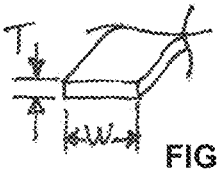
FIG. 8

STRUCTURAL SHEAR TIE CONNECTOR FOR SANDWICHED INSULATED CONCRETE AND SANDWICHED INSULATED CONCRETE WALLS/PANELS

CROSS REFERENCE TO RELATED APPLICATIONS

This application claims the benefit of U.S. Provisional Application Ser. No. 63/795,573, filed on Apr. 27, 2025, which is hereby incorporated by reference in its entirety.

BACKGROUND

Technical Field

This disclosure generally relates to precast concrete and insulation composite panels in which a layer of insulation is sandwiched between exterior layers of concrete.

Description of the Related Art

A structural shear tie connector is used in sandwiched, poured-in-place, concrete insulated elements and in sandwiched, insulated concrete precast wall panels. These elements and wall panels have a first and second concrete layer or wythes and a rigid insulation layer interposed therebetween as generally described in U.S. Pat. No. 6,088,985 to Clark (hereinafter "Clark'985"). The shear tie connectors described in Clark'985 have a double-bow-tie configuration, which describes required strands that cross each other at a plurality of points/locations. Opposing ends of the double-bow tie configuration are embedded in opposing concrete layers, so the connectors extend through the insulation layer to provide a shear connection between the concrete layers while providing a non-thermally-conductive connection (thermal bridge) between the concrete layers. Clark'985 discloses the strands are wound around a mandrel and then impregnated with ester resins to form a continuous roving (col. 3:55-58), with the resin providing no strength because all loads are carried by the fibers (col. 4:51-54). Thus, while formed of fiberglass reinforced plastic, the strands are "formed as a continuous unwelded structure" (col. 2:30-31).

U.S. Pat. No. 6,761,007 to Lancelot III et. al. (hereinafter Lancelot III), adds additional longitudinal legs to the double-bow-tie configuration for increased strength. However, Lancelot III also teaches the use of a winding pattern especially chosen so that the density of the fiber does not substantially increase at the various points of intersection of different links on the connector (col. 4, lines 1-5). Lancelot III shows the links crossing each other several times, but does not disclose how two strands of the same fiberglass fibers can be arranged cross-perpendicularly to each other, while not doubling the number of strands at those crossing intersections. Similar to Clark'95, Lancelot III discloses a fiber that is wound on a mandrel first and then impregnated with resin or covered with resin (col. 3:58-60).

A commercial embodiment of the strengthened connector of the Lancelot III is shown in the drawing of FIG. 11. The connector 1105, which is now conventional, is disclosed in Lancelot III as being a double-bow-tie connector. Loosely wound fiberglass fiber filaments are manually pressed into a cavity mold having the shape of the double bow tie connector, which is then injection molded with resin through injection ports that are located at four centrally located, crossing-intersections formed by the double-bow-tie configuration. The four central injection ports form raised, circular bosses resembling thin washers that extend outward from the remainder of the connector. The resulting connector has a rectangular cross-section except at the location of the injection ports and at the location of recesses formed by ejection pins, all of which are located on the wide side of the rectangle. The resin is liberally used, as considerable portions of the commercially sold connectors appear to have no fibers in them, as seen in FIG. 11.

The double-bow tie connector is geometrically complex and has a plurality of structurally complex fiber strand intersections. The commercial embodiment has the fiber strands loosely placed in a large amount of resin, with the multi-fiber strand intersections separated from each other by large amounts of resin. If the fiber strands were tightly wound in the same plane when they crossed at right angles, that crossing would deflect the crossing fiber strands into an out-of-plane alignment/orientation. When these fiber strands are deflected out of pure straight line orientations (or out-of-plane orientation), then when loads are applied to the sandwiched insulated panel, resistance to this loading requires the impregnating resin to reinforce/restrain the fiber strands from lateral or transverse movement. This construction is analogous to placing two rubber bands in a crossing X-shaped configuration, and then stretching each rubber band. The rubber band on the bottom is pushed downward by the top rubber band where the two bands cross, and the top rubber band is deformed upward where the two bands cross. If the rubber bands were embedded in an epoxy, then the resin in the matrix would try to hold the rubber bands from moving toward or away from the table surface, carrying the vertical load caused by the deformation arising from crossing the rubber bands. However, the resin is very weak compared to the tensile strength of the fiber strands. Thus, there is a need to improve or eliminate the crossing intersections of the fiber strands as in conventional structures, and to improve the tensile strength of the shear tie connectors.

Further, the double bow-tie connector is thicker at the location of the raised, annular bosses where the resin is injected to mold the connector, but is thinner in between those bosses. This non-uniform thickness results in the annular bosses abutting the insulation layers and thus creates a larger space between them than required to accommodate the thickness of a connector having a uniform thickness.

Moreover, the fiberglass filaments in the commercial embodiments of these patents are not uniformly spaced, and neither tightly packed nor consistently dense at either the corners or the straight lengths of the commercially sold connector, with the result that the encasing resin carries a substantial portion of the load transmitted by the fibers encased in the resin. Thus, there is a need for a more compact and more effective load-carrying arrangement for the fibers or filaments in the shear tie connector.

Indeed, when illuminated by a light located opposite the viewing side, the double bow-tie connector appears to have numerous areas composed entirely of resin with no filaments. There is thus a need for a shear tie connector with a more consistent and higher ratio of filaments to binder, especially over the load-carrying portion of the connector. There is also a need for a way to consistently make such connectors.

Moreover, the fiberglass filaments in the double bow-tie configuration of this conventional connector, cross each other at 90 degree angles, at four internal crossing locations, causing one or both of the crossing filaments to be displaced out of plane so that when a tension load is applied to the crossing filaments, at least one of the each pair of crossing of strands is displaced out of plane which transfers load from the stronger filament to the weaker resin and which limits and degrades the strength and stiffness of the connector. Moreover, as seen in FIG. 11, the commercial embodiment also shows three loose strands of fiber extending around at least a portion of each of the four exterior corners with a variable fiber density and curvature of each strand, often a multitude of resin-filled gaps visible between the fibers. There is thus a need for a shear tie connector which can eliminate or reduce the crossings of strands and reduce the transfer of loads to the entraining binder so the filaments carry and continue to carry the loads during use.

Moreover, the conventional shear tie connectors have relatively small openings through which concrete reinforcing members (e.g., rebar) may pass. There is thus a need for a shear tie connector with larger openings for supporting concrete reinforcing structures and accommodating the passage of such concrete reinforcing structures. And further, the relatively small openings may inhibit a thorough embedment of the connector's ends into the wet concrete wythes. There is thus a need for a shear tie connector with large unencumbered large openings.

SUMMARY

The improved shear tie and methods of manufacture disclosed herein incorporate the structural configuration requirements with the incorporation of high-strength, low thermal-conducting properties of fiberglass/carbon fiber/synthetic polymer fiber to meet both structural and thermal requirements. The structural shear tie connectors disclosed herein may collect and resist superimposed loads/forces between the concrete wythes, which results in structural control of longitudinal bending within a panel. With a more efficient/stronger structural connector, fewer connectors are required to resist an equal superimposed load(s), and/or yield higher level composite load resisting result(s). Further, the improved shear tie disclosed herein allows increased strength and stiffness in a thinner connector, which is believed to also allow lower thermal conductivity than the conventional structures.

The present design also eliminates the crossing fiber strands of the conventional shear tie connectors' load-resisting fiber linear alignment(s) and thus reduces or eliminates the out-of-plane, non-linear deformation of the connector and the forces from those crossing fiber strands that distort the connector. This allows a linear and in-plane fiber strand to resist loading of the sandwiched panel in a straight load-resisting tension, and without depending on the resin to carry the high loads transmitted to the resin from deformation of the fibers intended to carry those high loads.

The specification is for a fiber wound 2-way composite acting shear connector for use in "sandwiched" insulating concrete elements, in which a layer of rigid insulation is "sandwiched" between two concrete wythes, with the "shear connector" embedded in the two exterior (sandwiching) concrete wythes through and across the centered rigid insulation layer, wherein this shear connector ties the two concrete wythes together, in a structural orientation that resists the inherent shear forces that result when and as the concrete assemblage element is subjected to superimposed service loads, both in-plane and perpendicular to the concrete's surface plane. The shear connector's size, integral materials, and shapes combine to yield a "composite" load resistance mechanism allowing the two concrete wythes, though separated by the centered layer of rigid insulation, to resist applied superimposed loads commensurate with that of a concrete element of equal solid thickness. This shear connector insert is designed for use in the fabrication/manufacturing of "sandwiched" insulated concrete assemblages (i.e., precast concrete insulated wall panels, slabs, and poured-in-place concrete walls and slabs). The basic purpose of this insert is to provide structural integrity, while reducing the quantity of concrete, while yielding an energy-efficient element:

The fiber-based shear connector is designed and fabricated using cement/concrete compatible fibers, fiberglass, synthetic polymer fibers (SPY), or carbon fiber (FG/CF), bonded with structural-based compatible resin(s).

The shear connector insert is constructed of two basic structural parts and four non-structural protrusions. The two structural shear resisting parts are mirrored, one to the other, and are initially individually shaped closed-loop "parallelograms". There are two non-structural resin-based parts positioned and functioning as shape-retaining gussets. The final non-structural resin-based parts are four "stand-off" positioning tabs, sized to assist in the accurate placement of the shear connector during the "sandwiched" concrete element's manufacture.

Each of the two "mirrored" structural parallelograms is specifically shaped, placed, and manufactured to maximize the shear connector's shear load resisting capacity. Each parallelogram loop part is of a continuous fiber winding with resin-impregnated FG/CF/SPY, without crossing fiber intersections, thus yielding true "in-plane" tension-carrying strut(s). Eliminating crossing intersections of additional fiber struts eliminates all potential lateral forces that can be induced within the rigid insulation portion(s) of the sandwiched assembly under induced service loads and load reversals.

The enclosed looped ends of the parallelograms are sized and shaped, that once embedded in the cured concrete wythe, to fully develop the load resisting capacity of the associated concrete wythe's thickness and cured concrete's strength.

The non-structural resin-based "gussets" are sized and located to "hold" the two FG/CF/SPY structural fiber parallelogram loops at a structurally selected angle to one another, and to provide sufficient strength to the total assemble during its handling, placing, concrete pouring, forming, and curing stages, until such time the sandwiched concrete element has reached its predetermined design strength.

In an embodiment, a shear tie connector for use with a concrete and insulation composite panel includes a first concrete wythe having an exterior surface and an opposite facing interior surface, a second concrete wythe having an exterior surface generally opposite the exterior surface of the first concrete wythe, an insulative layer interposed between the first and second wythes, the insulative layer having at least one slot extending therethrough of predetermined width, the shear tie connector having two opposing ends each of which is embedded in a different one of the first and second wythes during use with the shear tie connector extending snugly through the at least one slot, the shear tie connector includes: a first and second connector loop each composed of thermally non-conductive fibers in a binder to form a matrix, each connector loop having a parallelogram shape with first and second opposing elongated and parallel sides and first and second opposing and parallel short ends, the shape further having first and second acute curved angles at two opposing corners and first and second obtuse curved angles at two opposing corners. The first and second connector loops are inclined relative to each other in the same plane in a V-configuration, with the two parallelogram shapes being mirror images of each other about an axis of symmetry located between the connector loops. The connector loops are joined by a gusset extending between the two parallelogram shapes. Wherein the gusset has sufficient strength for manual installation of the joined V-shaped connector loops into the first wythe while the concrete of the first wythe is still wet and pliable.

In an embodiment, which may be combined with the preceding embodiment, the acute angled corners of the first and second parallelogram shapes are adjacent each other and connected by the gusset.

In an embodiment, which may be combined with one or more of the preceding embodiments, the connector has an acute angle with a curvature of about 0.4 to 0.6 inches.

In an embodiment, which may be combined with one or more of the preceding embodiments, the parallelogram shapes have an interior facing edge and an opposing exterior facing edge, the interior facing edges of the elongated sides and short ends being straight between the curved corners and the exterior facing edges being slightly curved outward between the corners a distance of less than about 0.2 inches.

In an embodiment, which may be combined with one or more of the preceding embodiments, the short end of each parallelogram is angled relative to the elongated side at an angle of 45° to 60°.

In an embodiment, which may be combined with one or more of the preceding embodiments, the first and second connector loops are inclined relative to each other at an angle of 45° to 60°.

In an embodiment, which may be combined with one or more of the preceding embodiments, the strands are made of graphite fibers in a vinyl resin binder.

In an embodiment, which may be combined with one or more of the preceding embodiments, the strands are made of fiberglass or synthetic polymer in a resin binder.

In an embodiment, which may be combined with one or more of the preceding embodiments, the strands are straight along a length of at least 95% of the length of the elongated sides and short ends measured between the ends of the curved corners on opposing ends of each length.

In an embodiment, which may be combined with one or more of the preceding embodiments, the strands form a single, continuous strand from a plurality of circuits extending sequentially about the periphery of one of the connector loops and overlaying the immediately prior circuit and being overlaid by the next following circuit.

In an embodiment, which may be combined with one or more of the preceding embodiments, the continuous strand has a rectangular cross section with a thickness smaller than the width, and with the thickness of each strand substantially overlaying the strand below it and being overlaid by the strand above it to form a stack of overlaid strands which stack forms a width of the connector loop.

In an embodiment, which may be combined with one or more of the preceding embodiments, the first and second elongated sides and short ends each have a rectangular cross-section having connector-thickness and a connector width, the connector-thickness corresponding to the width of the wetted and wiped strands measured orthogonal to the plane, which connector-thickness is smaller than the connector-width, and wherein the connector width comprises a plurality of the wetted and wiped strands each having a rectangular cross section with a strand-width of the wetted and wiped strands corresponding to the connector-thickness.

In an embodiment, which may be combined with one or more of the preceding embodiments, each connector loop comprises plurality of rectangular wetted and wiped strands having a width and a thickness and stacked on top of each other in the thickness direction to form a width of the connector measured in the plane, with the width of the wetted and wiped strands corresponding to a thickness of the connector measured orthogonal to the plane.

In an embodiment, which may be combined with one or more of the preceding embodiments, the density of fibers to binder in the matrix is at least 10% greater at each of the corners on opposing ends of one of the elongated sides, compared to the density of fibers to binder in the matrix at the middle of said one of the elongated sides.

In an embodiment, which may be combined with one or more of the preceding embodiments, the density of fibers to binder in the matrix is at least 10% greater at each of the corners on opposing ends of one of the short ends, compared to the density of fibers to binder in the matrix at the middle of said one of the short.

In an embodiment, a concrete and insulation composite panel having a first concrete wythe, a second concrete wythe, and a plurality of insulation strips disposed side-by-side between the first and second concrete wythes to form a plurality of slots adjacent ones of the insulation strips, includes at least one shear tie connector of claim 1 having two opposing ends each of which is embedded in a different one of the first and second wythes to hold the wythes together.

In an embodiment, which may be combined with one or more of the preceding embodiments, In an embodiment, which may be combined with one or more of the preceding embodiments, the concrete and insulation composite panel includes insulating foam disposed in a slot between the plurality of insulation strips.

In an embodiment, which may be combined with one or more of the preceding embodiments, In an embodiment, which may be combined with one or more of the preceding embodiments, a concrete and insulation composite panel having a first concrete wythe, a second concrete wythe, and a plurality of insulation strips disposed side-by-side between the first and second concrete wythes to form a plurality of slots adjacent ones of the insulation strips, has at least one shear tie connector with two opposing ends each of which is embedded in a different one of the first and second wythes to hold the wythes together.

In one embodiment, a method of winding a shear tie connector loop from a spool of dry fiber strands comprising one of fiberglass roving, graphite tow and synthetic polymer yarn, the connector loop for use in structurally connecting first and second concrete wythes on opposing sides of an insulating layer having at least one slot extending through the insulating layer with the connector loop extending through at least one slot to at least partially achieve said structural connection, the method includes the steps of:

pulling a strand of said dry fiber under tension through a wetting reservoir containing a binder that hardens as it cures and is substantially cured within 40 about minutes, the strand having a rectangular cross-sectional shape and the tension being sufficient to prevent curling of that shape into a closed tube; pulling the wetted strand under tension through a wiping station having a rectangular wiping orifice to wipe excess binder off of the wetted strand, the tension being sufficient to prevent curling of that shape into a closed tube; wrapping the wetted and wiped strand under tension about a first mandrel rotating about a mandrel axis and having an outward facing shape of a parallelogram with two long straight sides and two short straight ends and four curved corners which include two acute corners and two obtuse corners with the acute corners having a radius of 0.4-0.6 inches, the tension being sufficient to maintain the wetted and wiped strand in a generally rectangular shape with a width and a thickness as said strand is wrapped about the mandrel which is bounded by two adjacent and generally parallel fenders that are spaced apart a distance about the same as the width of the wetted and wiped strand, so the width of each successive strand lays on top of the width and length of a prior strand around a substantial portion of a periphery of the prior strand to form a first stack of wetted and wiped strands; and curing the binder to form a first parallelogram-shaped loop formed by said stack of fiber strands in a binder matrix which loop is suitable for use as one of two loops in the shear tie connector when said stack of cured strands is removed from the mandrel.

In an embodiment, which may be combined with one or more of the preceding embodiments, the method includes that the binder has a vinyl resin that cures in about 15-20 minutes.

In an embodiment, which may be combined with one or more of the preceding embodiments, the fiber is graphite tow and the binder comprises a vinyl resin.

In an embodiment, which may be combined with one or more of the preceding embodiments, the fiber is a fiberglass roving and the binder comprises a vinyl resin.

In an embodiment, which may be combined with one or more of the preceding embodiments, the tension is less than about 10-15 pounds and the strand has a width of less than 0.5 inches.

In an embodiment, which may be combined with one or more of the preceding embodiments, the width of the wetted and wiped strand is the same as or slightly smaller than a specified width of said at least one slot.

In an embodiment, which may be combined with one or more of the preceding embodiments, the stack of wetted and wiped strands has cured to form strands bound in a matrix, the stack of cured strands has a minimum corner width measured along a radial direction of the curvature of each acute angled corner, and wherein the stack of cured strands has a maximum width measured perpendicular to the long straight side and extending through the thickness of the strands, and wherein the maximum width of the long straight side is greater than the corner width by about 30% or less.

In an embodiment, which may be combined with one or more of the preceding embodiments, wherein at least one of the fenders has a slot therein inclined at an acute angle relative to a plane orthogonal to the mandrel rotational axis, the slot extending from an outer periphery of said at least one of the fenders to a second mandrel rotating about the mandrel axis on the opposing side of the at least one of the fenders, and the method further includes before the curing step, moving the wet and wiped strand through the slot and onto the second mandrel rotating with the first mandrel about the mandrel axis, and wrapping the wetted and wiped strand under tension about the second mandrel which has an outward facing shape of a parallelogram with two long straight sides and two short straight ends and four curved corners which include two acute corners and two obtuse corners with the acute corners having a radius of 0.4-0.6 inches, the tension being sufficient to maintain the wetted and wiped strand in a generally rectangular shape with a width and a thickness as said strand is wrapped about the mandrel which is bounded by the fender with the slot and an adjacent that is generally parallel to the fender with a slot that is spaced apart a distance about the same as the width of the wetted and wiped strand, so the width of each successive strand lays on top of the width and length of a prior strand around a substantial portion of a periphery of the prior strand as it winds about the second mandrel to form a second stack of wetted and wiped strands; and wherein the curing step includes curing the binder to form a second parallelogram-shaped loop of fiber strands in a binder matrix suitable for use in forming the shear tie connector when said second loop of fiber strands is removed from the mandrel.

In an embodiment, which may be combined with one or more of the preceding embodiments, the method includes cutting the wetted and wiped strand that moves through the slot in the fender.

In an embodiment, which may be combined with one or more of the preceding embodiments, the moving step moves the strand through a slot having opposing side walls forming a generally V-shaped slot with the side walls each inclined at an angle of about 60° in a direction opposite the direction in which the fender rotates.

In an embodiment, which may be combined with one or more of the preceding embodiments, the V-shaped slot expands at an angle of about 30° from the mandrel outward and away from the rotational axis of the mandrel.

In an embodiment, which may be combined with one or more of the preceding embodiments, a tie shear connector for concrete wythes, includes two shear-resisting closed loops configured in a strutless, substantially open, V-shaped formation; at least two non-structural gussets having different lengths, the two non-structural gussets are arranged between the two shear-resisting closed loops to retain the two shear-resisting closed loops in the V-shaped formation at a predetermined angle; and a plurality of spacing tabs arranged along ends of the two shear-resisting loops above and below the two gussets;

wherein the tie-shear connector is constructed of one or more thermally non-conductive materials.

In an embodiment, which may be combined with one or more of the preceding embodiments, the tie shear connector further includes that the strutless, substantially open V-shaped formation of the two shear-resisting closed loops are retained only via the at least two non-structural gussets.

In an embodiment, which may be combined with one or more of the preceding embodiments, the two shear-resisting closed loops includes two substantially parallelogram-shaped closed loops.

In an embodiment, which may be combined with one or more of the preceding embodiments, the parallelogram-shaped closed loops are sized and shaped to enhance a load resisting capacity of concrete wythes based on a thickness and a cured concrete strength of the concrete wythes.

In an embodiment, which may be combined with one or more of the preceding embodiments, the plurality of the spacing tabs comprises four spacing tabs, and the spacing tabs are arranged at longitudinal ends of the parallelogram-shaped closed loops.

In an embodiment, which may be combined with one or more of the preceding embodiments, the spacing tabs are non-structural spacing tabs made of resin.

In an embodiment, which may be combined with one or more of the preceding embodiments, the at least two non-structural gussets are made of resin.

In an embodiment, which may be combined with one or more of the preceding embodiments, the substantially parallelogram-shaped closed loops comprise a continuous fiber winding with resin-impregnated fiberglass or carbon fiber (FG/CF/SPY).

In an embodiment, which may be combined with one or more of the preceding embodiments, wherein an angle Z between the parallelogram closed loops ranges between 45 to 60 degrees when an X dimension ranges between 6 to 8 inches, and a Y direction ranges between 10-12 inches, wherein X dimensions are industry standards, and Y dimensions vary per industry convenience, with angle Z changing as Y changes.

In an embodiment, which may be combined with one or more of the preceding embodiments, an angle Z between the parallelogram closed loops ranges between 55 to 60 degrees when an X dimension ranges between 10 inches to 12 includes, and the Y dimension is 15 inches.

In an embodiment, which may be combined with one or more of the preceding embodiments, a concrete and insulation sandwich wall panel, includes a first concrete wythe having an exposed surface, a second concrete wythe having an exposed surface generally opposite the exposed surface of the first concrete wythe, an insulative layer interposed between the first and second wythes, the insulative layer having at least one gap therethrough in communication with both the first and second concrete wythes, a structural tie shear connector extending through the gap and embedded into the first and second concrete wythes, the tie shear connector includes:

two shear-resisting substantially parallelogram-shaped closed loops configured in a strutless, substantially open, V-shaped formation; at least two non-structural gussets having different lengths, the two non-structural gussets are arranged between the two shear-resisting closed loops to retain the two shear-resisting closed loops in the V-shaped formation at a predetermined angle; and a plurality of spacing tabs arranged along ends of the two shear-resisting loops above and below the two gussets.

In an embodiment, which may be combined with the preceding embodiment, the tie shear connector is constructed of one or more thermally non-conductive materials.

In an embodiment, which may be combined with the preceding embodiments a portion of a first of the two parallelogram-shaped closed loops is encased by the first concrete wythe and a portion of a second of the two parallelogram-shaped closed loops is encased by the second concrete wythe.

In an embodiment, which may be combined with one or more of the preceding embodiments, an angle Z between the parallelogram closed loops of the tie shear ranges between 45 to 60 degrees when an X dimension ranges between 6 to 8 inches, and a Y direction ranges between 10-12 inches.

In an embodiment, which may be combined with the preceding embodiment an angle Z between the parallelogram closed loops of the tie shear ranges between 55 to 60 degrees when an X dimension ranges between 10 inches to 12 includes and the Y dimension is 15 inches.

In an embodiment, a method of manufacturing a tie shear connector for concrete wythes, the method includes providing two shear-resisting closed loops configured in a strutless, substantially open, V-shaped formation; arranging at least two non-structural gussets having different lengths between the two shear-resisting closed loops to join the two shear-resisting closed loops in the strutless, substantially open V-shaped formation at a predetermined angle; and arranging a plurality of spacing tabs arranged along ends of the two shear-resisting loops above and below the two gussets; wherein the tie-shear connector is constructed of one or more thermally non-conductive materials.

In an embodiment, which may be combined with the preceding embodiment, the method includes the two shear-resisting closed loops are formed of two substantially parallelogram-shaped closed loops formed of a continuous fiber winding with resin-impregnated fiberglass or carbon fiber (FG/CF/SPY).

In an embodiment, which may be combined with one or more of the preceding embodiments, the method includes that the two parallelogram-shaped closed loops are sized and shaped to enhance a load resisting capacity of concrete wythes based on a thickness and a cured concrete strength of the concrete wythes.

In an embodiment, which may be combined with one or more of the preceding embodiments, the arranging of the plurality of the spacing tabs includes arranging a first spacing tab and a second spacing tab, at opposite longitudinal ends of a first loop of the parallelogram-shaped closed loops, and arranging a third spacing tab and a fourth spacing tab at opposite longitudinal ends of a second loop of the two parallelogram-shaped closed loops.

In an embodiment, which may be combined with one or more of the preceding embodiments, the providing of the two shear-resisting closed loops further includes configuring a preformed mandrel in a selected loop shape and arranging the mandrel in a turning orientation in which the rotation of the mandrel's long axis is maintained such that the tie shear connector's structural based fibers comprised of either fiberglass rovings and/or carbon fiber tow impregnated with a structural binding structural resin is continuously wound onto the turning loop-shaped mandrel in multiple layers; producing a selected length of a loop billet by identifying when a predetermined structural thickness of the resin impregnated fiber thickness is attained along the full length of the turning/rotating mandrel; curing the formed resin/fiber billet to a rigid state and removing the resin/fiber billet from the mandrel; positioning the rigid cured formed resin/fiber billet such that loop elements of the structural tie shear connector are sliced from the length of billet to produce a structurally selected loop thickness; and orienting an angle of the sliced loop to substantially match a selected angle of gain of the resin/fiber winding angle positioned onto the forming mandrel, such that the formed and sliced structural shear connector loop retains the structurally selected number of uninterrupted/continuous lengths of fiber roving/tow within the selected thickness of the now configured loop.

In an embodiment, which may be combined with one or more of the preceding embodiments, the method includes that the two shear-resisting closed loops are formed separately.

In an embodiment, a loop winding fabrication process includes winding an individual single parallelogram loop onto a mandrel clamped between two guide fenders.

In an embodiment which may be combined with the preceding embodiment, the loop winding fabrication process includes providing a single undivided winding mandrel of extended length bound by two end placed retaining fenders to produce a single continuous fiber wound billet, and where a cross-section of the continuous fiber wound billet retains the same dimensions and configurations as a construction of separate individual wound loops.

A shear tie connector is provided for use with a concrete and insulation composite panel having a first concrete wythe having an exterior surface and an opposite-facing interior surface. The panel has a second concrete wythe having an exterior surface generally opposite the exterior surface of the first concrete wythe and an insulative layer interposed between the first and second wythes. The insulative layer has at least one slot extending therethrough of predetermined width. The shear tie connector has two opposing ends, each of which is embedded in a different one of the first and second wythes during use, with the shear tie connector extending snugly through the at least one slot.

The shear tie connector advantageously includes a first and second connector loop each made of thermally non-conductive fibers in a binder to form a matrix, each connector loop having a parallelogram shape with first and second opposing elongated and parallel sides and first and second opposing and parallel short ends with the sides and ends joined by curved corners which form first and second acute angles at two opposing corners and first and second obtuse angles at two opposing corners. The first and second connector loops are inclined relative to each other and lie in the same plane in a V configuration, with the two parallelogram shapes being mirror images of each other about an axis of symmetry located between the connector loops. The connector loops may be joined by a gusset extending between the two parallelogram shapes. The advantageously has sufficient strength for manual installation of the joined V-shaped connector loops into the first wythe while the concrete of the first wythe is still wet and pliable.

Preferably, the acute angled corners of the first and second parallelogram-shaped connector loops are adjacent each other and connected by the gusset. The acute angled corners of the parallelogram-shaped connector loops advantageously have a curvature of about 0.4 to 0.6 inches, and preferably a curvature of about 0.5 inches. Additionally, the parallelogram-shaped connector loops each have an interior facing edge and an opposing exterior facing edge, the interior facing edge of the elongated sides and short ends being straight between the curved corners, while the exterior facing edges are slightly curved outward between the corners a distance of about 0.2 inches or less. Advantageously, the short end of each parallelogram-shaped connector is angled relative to the elongated side of the connector at an angle of 45° to 60°s, with an angle of about 50° being preferred. Advantageously, the V-shaped orientation of the first and second connector loops is achieved by inclining the loops relative to each other at an angle of about 45° to 60°, with an inclination angle of about 50 degrees being preferred.

Strands made of graphite fibers in vinyl resin binder are believed to be the strongest, while strands made of fiberglass or synthetic polymer in a resin binder are likely weaker but are also less expensive. The strands are advantageously straight along at least 90% and preferably 95% of the length of the elongated sides and short ends measured between the ends of the curved corners on opposing ends of each length. Further, the strands preferably include a single, continuous strand forming a plurality of circuits extending sequentially about one of the connector loops and overlaying the immediately prior circuit and being overlaid by the next following circuit.

Advantageously, the continuous strand has a rectangular cross-section with a strand-thickness smaller than the strand-width, and with the thickness of each strand substantially overlaying the strand below it and being overlaid by the strand above it to form a stack of overlaid strands, which stack forms a width of the connector loop measured in the plane of the connector loop.

Alternatively described, the first and second elongated sides and short ends each have a rectangular cross-section having a connector-thickness and a connector-width, the connector-thickness corresponding to the width of the wetted and wiped strands measured orthogonal to the plane of the connector loops. The connector width includes a plurality of the wetted and wiped strands, each having a rectangular cross section with a strand-width of the wetted and wiped strands corresponding to the connector-thickness. The connector thickness is smaller than the connector width. The preferred layup of the connector loops may be described as having a plurality of rectangular wetted and wiped strands having a strand-width and a strand-thickness that are stacked on top of each other in the strand-thickness direction to form a width of the connector measured in the plane of the connector loop(s), and the width of the wetted and wiped strands correspond to a thickness of the connector measured orthogonal to the plane containing the connector loop(s).

The overlapping of successive strands having a rectangular cross-sectional shape to form a single stack of the desired dimensions of the connector loops is believed to provide the greatest ratio of fibers to binder. Other strand arrangements may be used to form the parallelogram-shaped connector loops, but those are not believed to have as high a ratio of strands to binder.

The density of fibers to binder in the matrix is at least 10% greater at each of the curved corners on opposing ends of one of the elongated sides, compared to the density of fibers to binder in the matrix at the middle of that one of the elongated sides. Similarly, the density of fibers to binder in the matrix is at advantageously least 10% greater at each of the corners on opposing ends of one of the short ends, compared to the density of fibers to binder in the matrix at the middle of said one of the short ends.

The above-described shear-tie-connector and variations thereof provides an improved concrete and insulation composite panel when the shear-tie-connector is inserted with the short end of each of the first and second connector loops in a different concrete wythe, and with the elongated sides of the first and second connector loops passing through the insulating layer. At least a portion of the elongated sides of the first and second connector loops is advantageously embedded in the first and second concrete wythes. Thus, the shear tie connector described herein forms an improved panel when two opposing ends, each shear tie connector are embedded in different ones of the first and second wythes to hold the wythes together.

There is also an advantageously provided method of winding a shear tie connector loop from a spool of dry fiber strands comprising one of fiberglass roving, graphite tow, or synthetic polymer yarn. The method advantageously includes the step of pulling a strand of said dry fiber under tension through a wetting reservoir containing a binder that hardens as it cures and is substantially cured within about 40 minutes or less. The strand may have a rectangular cross-sectional shape, and the tension is advantageously sufficient to prevent curling of that rectangular cross-sectional shape into a closed tube. The method advantageously also includes pulling the wetted strand under tension through a wiping station having a rectangular wiping orifice to wipe excess binder off of the wetted strand, with the tension being sufficient to prevent curling of that shape into a closed tube. The method also advantageously includes the step of wrapping the wetted and wiped strand under tension about a first mandrel rotating about a mandrel axis. The mandrel has an outward-facing shape of a first parallelogram with two long straight sides and two short straight ends and four curved corners, which include two acute corners and two obtuse corners. The acute corners advantageously have a radius of 0.4-0.6 inches. The tension is sufficient to maintain the wetted and wiped strand in a generally rectangular shape with a strand width and a strand thickness as said strand is wrapped about the mandrel. The mandrel is bounded by two adjacent and generally parallel fenders that are spaced apart a distance about the same as the strand width of the wetted and wiped strand. The strand is wound the width of each successive strand lying on top of the width and length of a prior strand around a substantial portion of the periphery of the previously wound strand to form a first stack of wetted and wiped strands. The method advantageously also includes the subsequent step of curing the binder to form a first parallelogram-shaped loop formed by said stack of fiber strands in a binder matrix, which loop is suitable for use as one of two loops in the shear tie connector when said stack of cured strands is removed from the mandrel.

In further variations, the binder used in the method includes a vinyl resin that cures in about 15-20 minutes. Advantageously, the method uses a fiber that comprises graphite tow, and the binder includes a vinyl resin. Alternatively, the method may use a fiber that includes fiberglass roving or synthetic polymer fibers, with the same binder or other suitable resin binders. Advantageously, the winding tension is less than about 10-15 pounds and the strand has a width of less than 0.5 inches. Dry strand widths of 3/16 and 5/16 inches are preferred. As desired, the width of the wetted and wiped strand may be selected to be the same as or slightly smaller than a specified width of a slot in the insulation layer of a concrete panel having the insulation layer between two concrete wythes, with the connector loop having opposing ends embedded in each of the two wythes.

The method may also include curing the stack of wetted and wiped strands to form strands bound in a matrix, where the stack of cured strands has a minimum corner width measured in a radial direction of the curvature of each acute angled corner (i.e.-parallel to the plane in which the first parallelogram lies) and wherein the stack of cured strands has a maximum width measured perpendicular to the long straight side and extending through the thickness of the strands, and wherein the width is greater than the corner thickness by about 30% or less.

The method may also include winding the wetted and wiped strands between the fenders wherein at least one of the fenders has a slot therein inclined at an acute angle relative to a plane orthogonal to the mandrel rotational axis, with the slot extending from an outer periphery of said at least one of the fenders to a second mandrel rotating about the mandrel axis and located on the opposing side of the at least one of the fenders. This method may also optionally include the step of moving the wet and wiped strand through the slot and onto the second mandrel rotating with the first mandrel about the mandrel axis, and doing so before the curing step. This last method step may further optionally include the additional step of wrapping the wetted and wiped strand under tension (which passed through the slot) about the second mandrel, which has an outward-facing shape of a second parallelogram having the same shape as the first parallelogram. This last step may be followed by the step of winding said strand around the second mandrel with a tension sufficient to maintain said strand in a generally rectangular shape so the width of each successive strand lays on top of the width and length of a prior strand around a substantial portion of a periphery of the prior strand as it winds about the second mandrel to form a second stack of wetted and wiped strands. A yet additional step may include curing the binder in the said strand wound about the second mandrel to form a second parallelogram-shaped loop of fiber strands in a binder matrix suitable for use in forming the shear tie connector when said second loop of fiber strands is removed from the mandrel.

The method may further include the step of cutting the wetted and wiped strand that moves through the slot in the fender. Alternatively, the connecting strand extending through the slot in the fender may be left uncut, and a gusset molded to connect the first and second loops of fiber.

A further variation on the above method(s) may include varying the moving step so it moves the strand through a slot having opposing side walls forming a generally V-shaped slot with the side walls each inclined at an angle of about 60 degrees in a direction opposite the direction in which the fender rotates. An additional variation includes moving the strand through the V-shaped slot, which expands at an angle of about 30 degrees from the mandrel outward and away from the rotational axis of the mandrel.

In a further variation to the above detailed plurality of individual winding mandrels and guiding/spacing fenders, a single undivided winding mandrel of extended length bound by just two end placed retaining fenders can be utilized to produce a single continuous fiber wound billet, who's cross section retains the same exact dimensions and configurations as that of the above detailed separate individual wound loops. This single extended length of billet production method eliminates a number of production complexities required to produce the noted individual loop(s) system. The above detailed steps of assembling the plurality of individual winding mandrels and their control guiding fenders, the plurality of "stepped" winding(s), the cutting of the fiber strand passing through the fender notched (following the curing period), separating the wound individual loops, mandrels, and fenders from the winding shaft, and any required post winding/curing removal of "flash", is replaced by "slicing" or saw cutting individual 3/16" to 5/16" loop segments from the first end of the now produced and cured length of billet. The thickness of these saw-cut loop slices is equal to the above detailed individual wound fiber loops, without need to further dress flash from these cut loop slices. This "billet" winding system variation does yield what is assessed to be an acceptable reduction in the previously noted wound loop system, based on a non-pure parallel layered winding of the fiber strands. With this fiber-wound billet system, the fiber wetting, tensioning, wiping, guide finger, and strand follower elements are as detailed above for the individual fiber-wound loops. This billet winding system utilizes an angled progressive fiber winding-layering requirement, in that, as the long-length billet mandrel is rotated, the tensioned wetted and wiped fiber (TWWF) strand is fed onto the extended length winding mandrel via the guide finger at an angle of approximately 1.5-2.0 degrees as the winding mandrel is rotated. This designated flat rotational angle of gain is set to produce an approximate 50% overlap with the preceding rapped fiber strand. This continuous rotational overlap fiber winding continues from immediately inside the billet winding mandrel's first fender for the full length of the billet mandrel's extended length, until the winding overlapped fiber strand reaches the inside of the billet mandrel's second/ending fender, where upon this terminus, the TWWF carriage is reversed direction to continue the rotational fiber strand overlapping winding direction back towards the inside of the billet winding mandrel's first fender. This overlap rotational fiber winding procedure, first in one direction then reversed to wind in the opposite direction, is repeated until the required number of fiber strand layers has been completed. There upon, the fully wound billet mandrel assemblage is left to cure/harden. Once the billet wound fiber and resin assemblage has cured, the billet winding mandrel is removed, leaving a full-length fiber/resin billet blank. The high-speed thin-bladed cutting saw, gauged to the cutting depth equal to the designed thickness (see Table 1, "W"), makes repeated cutting "slices" from the fiber wound billet, to yield fully formed individual fiber wound connector loops. As this connector loop production variation results in a "bias-plied" fiber angle of approximately 1.5-2.0 degrees in lieu of the aforementioned detailed true "parallel" wound fiber strands, proportional reduction in load resisting strength of less than 1.0% is expected.

BRIEF DESCRIPTION OF THE DRAWINGS

The above and other features and advantages of the improved shear tie connector will be made more apparent when taken into consideration of the drawings in which like numbers refer to like parts throughout, and in which:

FIG. 6 is a schematic view of a process for winding strands around a mandrel to form a V shear tie connector;

FIG. 7 is a partial sectional view showing strands wound on a mandrel; and

FIG. 8 is a schematic perspective view of a strand of fibers with a rectangular cross-section;

DETAILED DESCRIPTION

Figure 1:
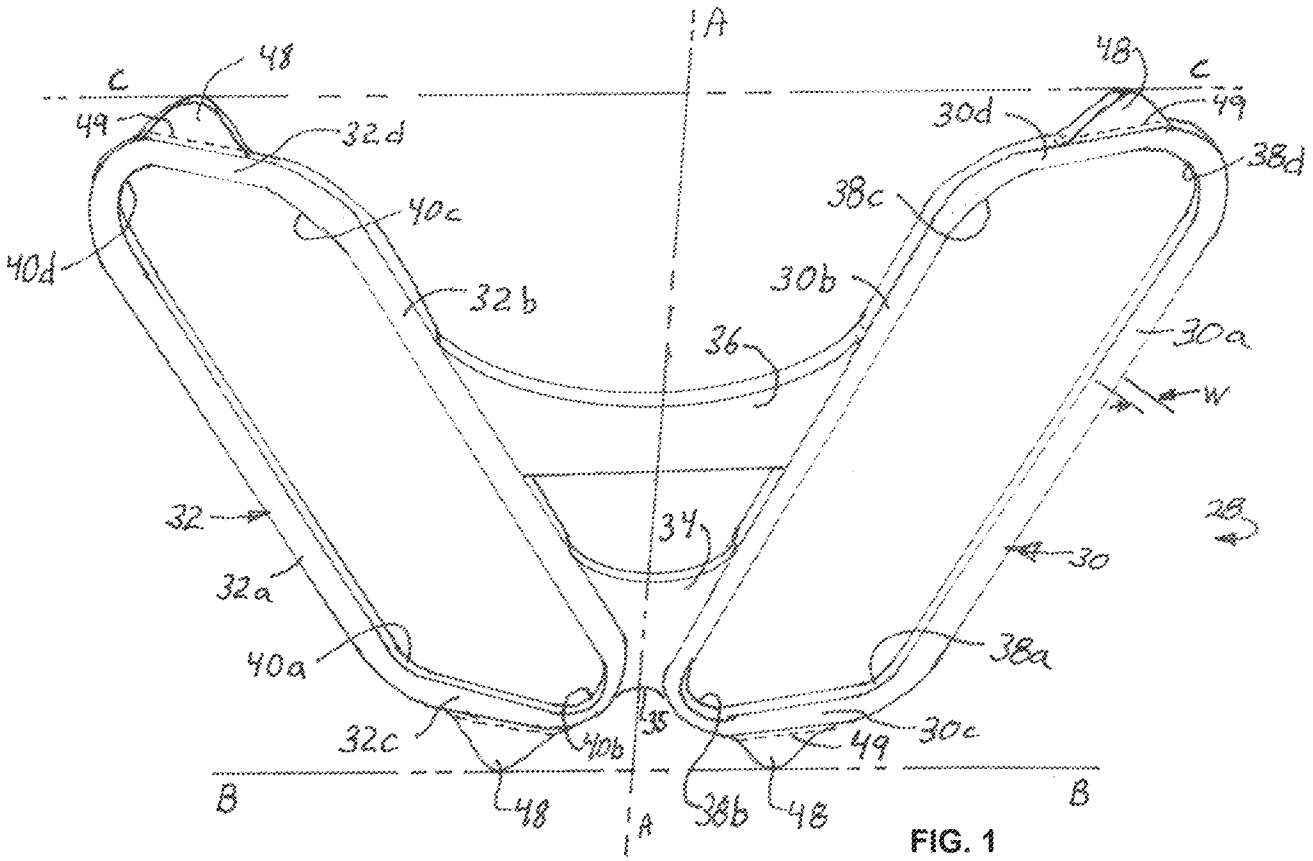
FIG. 1 is a perspective view of a V tie shear connector in a first orientation with the narrow end of the V oriented downward.

As used herein, the term "a strutless substantially V-shaped formation" refers to a tie-shear connector having a configuration of two loops arranged in a V-shape without crossing fiber intersections of additional fiber struts (e.g., strutless). A strutless configuration (without fiber struts between the closed loops) eliminates all potential lateral forces that may be induced within rigid insulation portions arranged between two concrete wythes in a sandwiched assembly.

As used herein, the term "non-structural gusset" refers to a gusset that is not primarily used for load-bearing or structural reinforcement. For example, a non-structural gusset may be arranged to stabilize non-load-bearing elements, provide minor support, or for aesthetic reasons. In one or more embodiments, non-structural gussets may be constructed of resin.

As used herein, the term "positioning tabs" (a.k.a. spacing tabs") refer to non-structural (an industry term for primarily non-load bearing and/or primarily not for structural reinforcement) tabs that are sized to assist in the accurate placing of the shear connector during a "sandwiched" manufacturer of concrete elements with a layer of rigid insulation.

A concrete and rigid insulation sandwich (wall) panel 20 is shown in FIGS. 1-5. The panel 20 includes first and second concrete wythes (layers) 22, 24, with a rigid insulation layer 26 suitable for use in the sandwiched concrete panel being interposed therebetween. A shear tie connector 28 has a different opposing end embedded in each concrete layer or wythe 22, 24 to structurally connect the two concrete layers/wythes with the insulation layer 26 therebetween, to form a sandwich construction that may be manipulated as a single unit.

The insulation layer 26 preferably includes high density polystyrene foam insulation, or similar material, having high thermal resistance (R-value) and sufficient strength to avoid compression from the weight of the concrete wythes during use. The insulation layer 26 is usually referred to in the trade as rigid because it has to maintain the spacing between concrete layers 22, 24 which abut opposing sides of the insulation layer during use—but there are clearly variations in the strength, thickness and stiffness of the insulation layer 26 encompassed by the reference to "rigid" insulation layer The insulation layer 26 typically varies from 1 to 8 inches (or more) and typically includes closed cell foams, including such materials as EPS (molded expanded polystyrene), XPS (extruded polystyrene), PUR (polyurethane) and PIR (polyisocyanurate), and suitable styrofoams. The thickness of the concrete layers or wythes also varies with the thickness of the insulation and the load requirements on the panels 20.

Figure 2:
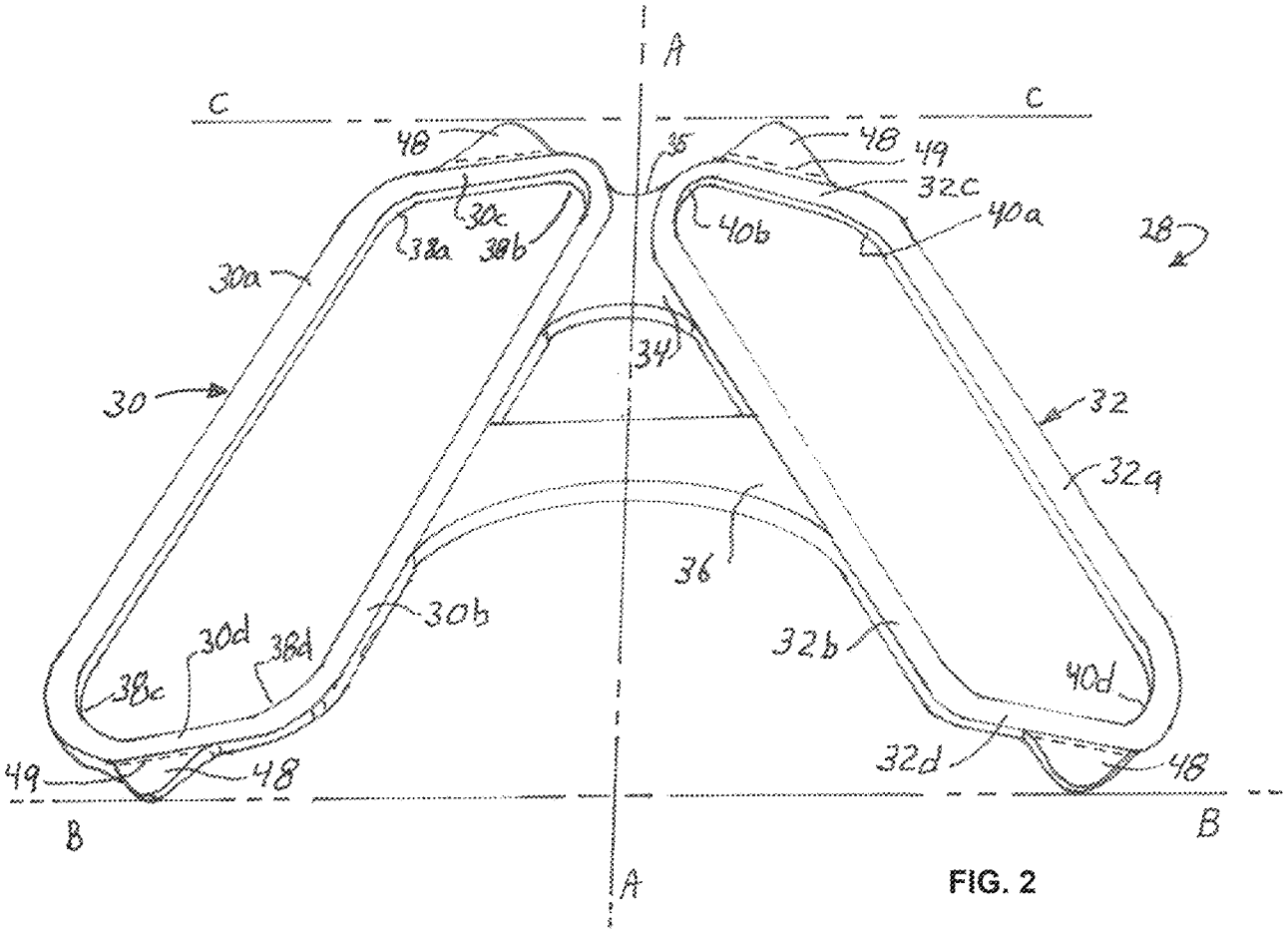
FIG. 2 is a perspective view of a V shear tie connector in a second orientation with the narrow end of the V oriented upward.
Figure 3:
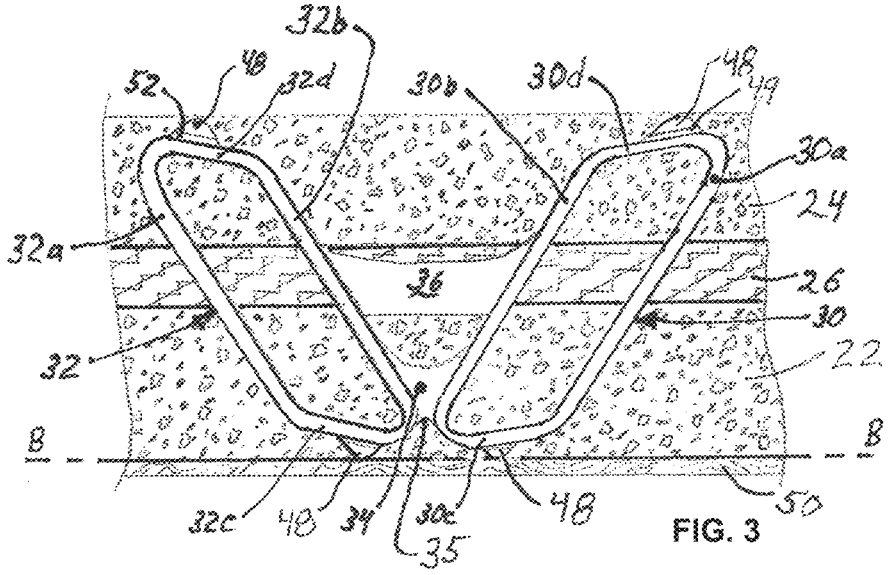
FIG. 3 is a partial sectional view showing the V shear tie connector in a first orientation with the narrow end of the V oriented downward and extending between first and second concrete layers or wythes.
Figure 4:
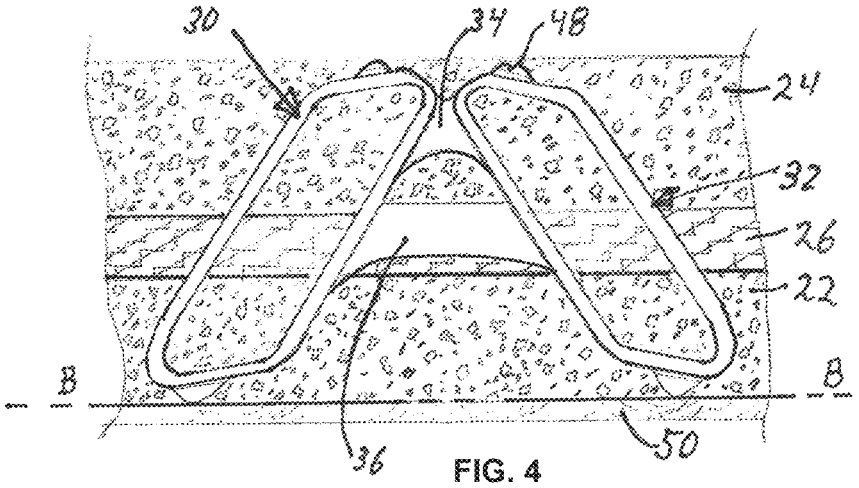
FIG. 4 is a partial sectional view showing the V shear tie connector in a second orientation with the narrow end of the V oriented upward and extending between first and second concrete layers or wythes.

The first connector loop 30 is a closed loop, preferably having a parallelogram shape with two opposing elongated and substantially straight sides 30*a*, 30*b* and two shorter opposing ends 30*c* and 30*d* which are also substantially straight. The elongated sides 30*a*, 30*b* are joined to the shorter ends 30*c* and 30*d* by interior curved corners 38*a*, 38*b*, 38*c*, and 38*d*. The connector loops 30, 32 are preferably connected by one or more gussets 34, 36, with the loops being located symmetrically about a common axis A-A extending through the gusset(s) 34 (and 36) which axis is typically vertical during manufacture of the panel 20 and usually horizontal (or inclined) when the panel is in use. The axes B-B and C-C in FIGS. 1-2 represent the tentative locations of the concrete form 50 during manufacture, depending on the orientation of the shear tie connector as shown in FIGS. 3-4. Thus, the second elongated connector loop 32 has a parallelogram shape with two opposing elongated sides 32*a*, 32*b* and two shorter opposing ends 32*c* and 32*d*, which elongated sides and short ends are joined at respective curved interior corners 40*a*, 40*b*, 40*c* and 40*d*.

The preferred shear tie connector 28 is a permanent assemblage of two parallelogram-shaped loops of continuous dense-wound fiber loops, preferably fabricated using one or more of industry standard fiberglass/carbon fibers or synthetic polymer fibers, impregnated ("wetted") with binding plastic/resin. before being wound to form the connector loops 30, 32. For ease of handling and installation, these two, separate elongated connector loops 30, 32 are advantageously joined for handling purposes into one structural shear tie connector 28 emulating two merged/joined "parallelograms" arranged to resemble an open V, with either end that V shape being embedded in the first concrete surface 22 during manufacturing of the insulated sandwich panel 20. As described below, the joinder of the two connector loops 30, 32 is by a non-structural gusset which is neither designed or made to carry anywhere near the forces or loads exerted on the elongated sides, short ends or corners connecting those parts.

The interior and exterior corners of each of the parallelogram-shaped connector loops 30, 32 are not sharp corners and are curved to reduce stress concentrations to suitable design levels, and preferably sufficiently curved at the parallelogram corners so that the curved fibers in those corners (especially the acute angled corners) and also in the juncture of the corners with the first and second elongated sides and short ends do not fracture during the designed use. The parallelogram's corners are also preferably sufficiently curved so the filaments in the strands 42 themselves do not break, and also such that the concrete inside the acute interior angles of the parallelogram-shaped connector loops does not spall, crack or break when the panels 20 are subjected to the design loads during use.

The preferred parallelogram shape of the first connector loop 30 has two acute angles of about 45° and two obtuse angles of about 135° between the straight portions of the elongated sides (e.g., 30*a*, 30*b*) and short ends (e.g., 30*c*, 30*d*) joined by those angles. However, the juncture of those sides and ends is curved, with a minimum radius of about 0.4-0.6 inches (preferably 0.5 inches) being preferred for the acute angle while a larger radius is desirable for the corners having an obtuse angle. These two sets of angles are not singularly fixed, as multiple shear connector tie applications require the first and second strands 42 and connector loops 30, 32 to have various configurations and sizes, as reflected in part by the illustrative dimensions in Table 1.

The first and second elongated loops 30, 32 may have various cross-sectional shapes, however a rectangular cross-sectional shape is believed preferable, with the longer axis of that rectangular cross-section parallel to or lying in the plane of the elongated loops during use as that is believed to provide a suitable configuration for the strength and stiffness needs for the majority of applications of the sandwich panel 20 in construction applications.

Referring additionally to FIGS. 6-8, the connector loops 30, 32 may include one or more elongated strands 42, preferably of carbon fiber impregnated with a binder 43 (such as vinyl resin) that cures to form a matrix 44 having the desired cross-sectional shape. Advantageously, a single strand 42 may be wound repeatedly around all sides, ends and corners of the connector loops 30, 32 with successive layers stacked on top of each other to achieve the desired dimension of each connector loop. Alternatively, a plurality of separate strands 42 may be used, as discussed later.

The strands 42, binder 43 and resulting matrix 44 are extremely strong in tension and provide a greater strength to weight ratio than steel, and are also not thermally conductive relative to the thermal conductivity of the concrete layers 22, 24 on opposing sides of the insulation layer 26, at least for most common uses of panels 20 in building construction. The strands and matrix also have a coefficient of thermal expansion close to that of the concrete in layers 24, 26 and certainly close enough that neither the shear tie connector nor concrete layers are damaged by environmental temperature changes.

Referring to FIGS. 1-5, the two shear tie connectors 28 are joined and advantageously takes the shape of a V, as it preferably has first and second connector loops 30, 23 arranged in a configuration similar to the named alphabet letter V. The shear tie connector 28 has first and second elongated connector loops 30, 32 joined and held in the V shaped configuration by at least first gusset 34 (preferably joined at the narrow end of the V) and optionally also joined and held by second gusset 36. Additional gussets may be used depending on strength requirements. The elongated connector loops 30, 32 and gussets 34, 36 are preferably flat so a common plane extends through each of those parts.

The first connector loop 30 preferably has a parallelogram shape with two opposing elongated sides 30*a*, 30*b* and two shorter opposing ends 30*c* and 30*d*. The elongated sides 30*a*, 30*b* are joined to the shorter ends 30*c* and 30*d* by curved corners 38*a*, 38*b*, 38*c* and 38*d* as best seen in FIGS. 1-4. The connector loops 30, 32 are preferably symmetric about a common axis A-A extending through the gussets 34, 36. Thus, second elongated connector loop 32 has a parallelogram shape with two opposing elongated sides 32*a*, 32*b* and two shorter opposing ends 32*c* and 32*d*, which sides and ends are joined at respective curved corners 40*a*, 40*b*, 40*c* and 40*d* as shown in FIGS. 1-2.

The first and second elongated loops 30, 32 may have various cross-sectional shapes, however a rectangular cross-sectional shape is believed preferable, with the longer axis of the rectangle parallel to or lying in the plane of the elongated loops as that is believed to provide a suitable configuration for the strength and stiffness needs for the majority of applications of the sandwich panel 20 in construction applications.

Referring to FIG. 6-8, the connector loops 30, 32 may include one or more elongated strands 42, preferably carbon fiber, bound in a binder or matrix 44, preferably a resin such as epoxy resin, to achieve the desired cross-sectional shape. A single strand 42 may be wound repeatedly around all sides, ends, and corners of the connector loops 30, 32, or a plurality of separate strands 42 may be used. The strands 42 may be extremely strong in tension and may provide a greater strength to weight ratio than steel when the strands are bound in a suitable matrix 44, thus allowing a strong shear tie connector 28 if the loops 30, 32 are oriented in the sandwich panel 20 so as to carry the panel loads in tension through the strands 42. Advantageously, the strands 42 and matrix 44 are not very thermally conductive relative to the conductivity of the layers on opposing sides of the insulation layer 26, at least for most common uses of panels 20 in building construction.

The two connector loops 30, 32 are advantageously inclined relative to each other and also preferably relative to axis A-A (FIGS. 1-2) at pre-selected angles that place the first and second elongated sides 30*a*, 30*b*, 32*a*, 32*b* to carry the majority of loads exerted on the panel 20 during use across the insulation layer 26, with the shorter ends 30*c*, 30*d*, 32*c*, 32*d* carrying the majority of loads exerted on the shear tie connector 28 in the planes of the concrete layers or wythes.

The V configured shear tie connector 28 can be utilized "upright" (i.e., V-orientation re FIG. 1, 3) or "inverted" (i.e., cone or funnel orientation re. FIGS. 1, 3). In either orientation, the V tie connector 28 extends through the insulation layer 26 as shown in FIGS. 3-4. The V tie connector design is compact, compatible with additional steel reinforcements, and has high composite shear strength due in part to the high fiber density (high ratio of fibers-to-resin), especially if a continuously wound single strand is used or a plurality of strands each wrapped multiple time around the sides and ends of each loop 30, 32.

When the V tie connector 28 is in a vertical orientation with Axis A-A vertical and each leg of the V opening upwards, away from the concrete form 50 as shown in FIGS. 1 and 3, the insulated concrete panel would be horizontal-which is the orientation for pouring the concrete layers to make panel 20. When the axis A-A is horizontal, the completed panel 20 would be vertical-which is the typical orientation for use of the completed panel 20, although the panel 20 may be at an inclined angle relative to the ground or relative to the vertical during use of the completed panel.

To provide the greatest strength and load-carrying capacity the strands 42 are preferably straight, or as straight as practical given variations arising from manufacturing the shear tie connectors 28 as described herein. Advantageously the strands 42 are substantially parallel as they extend along the first and second elongated sides 30*a*, 30*b*, 32*a*, 32*b* of the first and second connector loops 30, 32. The strands 42 are also advantageously parallel as they extend along the first and second short ends 30*c*, 30*d*, 32*c*, 32*d* of the first and second connector loops 30, 32. Moreover, the strand(s) 42 are preferably straight over a substantial length (over 80%) of the respective short ends and long sides of the first and second connector loops 30, 32—both measured between the beginning of the curvature for the parallelogram corners, and are more preferably straight over at least 90% of those lengths, and ideally straight 95% or more of those lengths. The longer the straight portion, the stronger the connector loops 30, 32 for their intended use.

The strands 42 extending along the length of the short ends 30*c*, 30*d*, 32*c*, 32*d* are preferably parallel to the midline of the concrete layers or wythes 22, 24 and are embedded therein so the concrete layers 22, 24 transfer load from the panel 20 to the strands by placing the strands 42 in tension. This is discussed further below.

Gussets

The first and second connector loops 30, 32 may be joined directly at or adjacent to the two corners of each loop which are nearest each other because of the relative inclination of the loops, such as corners 38*b*, 40*b* in FIGS. 1-4. Adhesives, thermal bonding or other joining methods may be used. Mechanical connectors are believed possible, however such connectors are undesirable as they would likely increase the thickness of the juncture which requires accommodating changes to the insulation layer that can increase thermal transfer-which is undesirable. Advantageously, the gussets 34, 36 are formed of the material used for the binder 43 and join the first and second connector loops 30, 32 as the gussets are formed.

Preferably a space or gap exists between adjacent ends (e.g., 30*c*, 32*c*) of the oppositely inclined first and second connector loops 30, 32. In fact, such a gap is useful in accommodating other reinforcing structures in the concrete layers 22, 24, such as rebar or prestressed strands. The distance between the closest portion of the first and second connector loops 30, 32 at outer periphery of the joined corners 38*b*, 40*b* is preferably about 1.5 inches, however this distance can vary as the design load requirements change. Some representative dimensions for different-sized components of the concrete panels 20 are given in Table 2 herein below.

TABLE 2

PREFERRED DIMENSIONS FOR COMMON CONCRETE PANELS

| "X" Height of Connector 28 | "Y" ± Max Width of Connector 28 | "A" Degrees ± Acute Angle | W +/− Strand Width | T +/− Strand Thickness | "B" Degrees +/− Obtuse Angle | R1/R2 +/− Radii Acute & Obtuse Angle |
|---|---|---|---|---|---|---|
| 6" | 10" | 45-60 | 5/16" | 3/16" | 135 | ½"/1" |
| 7½" | 12" | 45-60 | 5/16" | 3/16" | 135 | ½"/1" |
| 8" | 12" | 45-60 | 5/16" | 3/16" | 135 | ½"/1" |
| 9½" | 15" | 55-65 | 5/16" | ¼" | 120 | ½"/1" |
| 10" | 15" | 55-65 | 5/16" | ¼" | 120 | ½"/1" |
| 12" | 15" | 55-65 | 5/16" | ¼" | 120 | ½"/1" |

This space or gap between the adjacent portions (e.g., corners 38*b*, 40*b*) of the first and second loops 30, 32 is at least partially bridged by at least first gusset 34 and optional additional gussets 36, to hold the first and second connector loops 30, 32 in position relative to each other which in turn maintains the inclination of the connector loops relative to each other, as well as maintaining the spacing of the loops 32, 34 apart from each other. The gusset(s) also hold the connector loops in a substantially planar or flat position-which also makes it easier to manipulate the shear tie connector 28 as it is inserted into the first concrete layer 22 and to substantially maintain the desired position of the shear tie connector 28 as the second concrete layer 24 is poured to entrain the shear tie connector 28, with the exterior surface of the second layer being finished as desired (e.g., trowel finish).

The gusset(s) 32, 34 are fastened to the adjacent elongated sides 30*b*, 32*b*, preferably along at least a portion of the length of those facing elongated sides. A joinder could be made between ends 30*c*, 32*c* and/or ends 30*d*, 32*d*; however those are believed less preferable as more material is required. If a single gusset 34 is used, the opposing sides are inclined, and the gusset has a generally trapezoidal shape. If a plurality of gussets 34, 36 are used, then they are of different lengths measured along a line perpendicular to the axis A-A in the plane of the gussets. Plural gussets 34, 36 offer the possibility of allowing opposing edges of one or more gussets to be entrained in one of the concrete layers 22, 24, which may effectively strengthen the non-embedded portions of the shear tie connector by forming shorter cantilevered portions of the connector 28. The gussets 34 are shown as having curved edges on those portions of the gussets that are not connected to the first and second connector loops 30, 32, with the curvature used to reduce stress concentrations in the shear tie connector 28.

The gussets are advantageously made of resin poured or injected onto a positioning fixture having a voided space configured with forming dams to tightly fit against or receive the corners or elongated sides to be joined by the gusset 34, 36 so the gussets may be formed of the same resin 43 used in the winding of the strands 42 and formation of matrix 44. Dams may be used to seal junctures between the connector loops 30, 32 and the mold shaped to the desired configuration of the gussets. Advantageously, the resin forming the gussets is cured on an expedited basis (e.g., added hardener or increased temperature) to improve throughput of the connector production. In some applications the gusset 34 adjacent two acute corners (e.g., 38*b*, 40*b*) may contain a connecting strand 43 used to wind each of the connector loops 30, 32 joined by that gusset.

Advantageously, but optionally, the first gusset 34 may have a curved side or edge joining the corners 38*b*, 40*b* and forming a chairing leg 35. The radius of curvature of this curved side forming chairing leg 35 is advantageously selected to receive an elongated concrete reinforcing or strengthening members 37 of the type used on concrete panels, such as rebar, or other concrete stiffening or strengthening members. The shape of the chairing leg 35 need not be curved as the mating portion of the concrete strengthening member may have a non-circular shape. Because such reinforcing members 37 are typically spaced at regular intervals in concrete, the chairing leg 35 also allows the shear tie connector 28 to be positioned on or close to an elongated rebar which in turn places the shear tie connector 28 not only at a predetermined location in the panel 20 but places the connector near an internal load bearing member (i.e., rebar 37) of the concrete panel. This closer proximity of the internal rebar to the shear tie connector 28 is believed to improve the transfer of loads from the concrete panel 10 to the shear tie connector, and vice versa.

Further, chairing legs 35 may be fastened to or formed as part of the outward facing edges of gussets 35, 36 or the first short ends 30*c*, 32*c* of the first and second connector loops 30, 32, or on the outward facing edges of the second short ends 30*d*, 32*d* of the first and second connector loops 30, 32, or on the edges of the gussets 34, 36—especially the in-plane and outward facing edges of those gussets. The chairing leg 35 locations may be varied as needed to ease/facilitate placement of supplemental concrete reinforcement bar(s) on the shear tie connector 28. This spacing and ability to accommodate rebar additions may provide for additional strength and rigidity to the overall sandwich insulated concrete panel 10.

The interior corners 38, 40 of the first and second connector loops 30, 32 and the corresponding outside corners opposite those respective interior corners, are sufficiently rounded to reduce stress concentrations to acceptable design levels while preferably maximizing the straight length of the elongated strands 42 that extend along the respective sides and ends of the first and second connector loops. The corners transition the tensile load between the short ends 30*c*, 30*d*, 32*c*, 32*d* and the tensile loads in the elongated sides 30*a*, 30*b*, 32*a*, 32*b*, with high shear loads occurring in those corners. As discussed herein, a higher density of fibers 42 to binder 43 at the corners of the parallelogram shaped correctors 30, 32 is desirable to transmit the loads between the short ends and the elongated sides.

Figure 5:
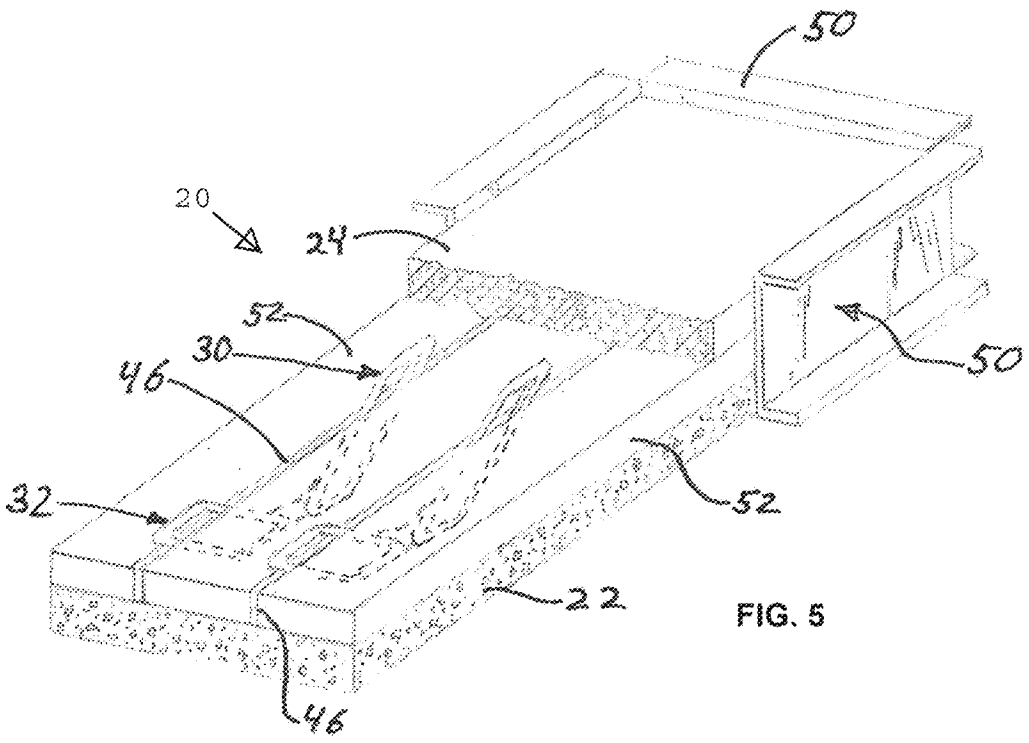
FIG. 5 is a perspective view of a precast concrete insulated sandwich wall panel or structure being formed with V shear tie connectors.

As seen in FIGS. 3-5, the first and second short ends 30*c* and 32*d* of the connector loops 30, 32 should reside in the concrete layer 22, during use of the shear tie connector 28. When installed in the first concrete layer 22 that ultimately forms the panel 28, the second short ends 30*d* and 32*d* of the connector loops 30, 32, remain above the first concrete layer 22 and above the insulation layer 26 along with a portion of the first and second elongated sides 30*a*, 30*b*, 32*a*, 32*b* of the connector loops 30, 32 which extend through slots 46 formed by gaps between adjacent insulation layers 26. Advantageously the first and second elongated sides 30*a*, 30*b*, 32*a*, 32*b* fit tightly or at least closely relative to the sides of the slots 46 in order to reduce thermal transfer through the slots 46. When concrete is subsequently poured to form the second concrete layer or wythe 24 of the concrete panel 10 to encase the remaining portions of the first and second connector loops 30, that poured concrete can enter any gap between the elongated sides 30*a*, 30*b*, 32*a*, 32*b* and the adjacent edges or sides of the slots 46 and thereby increase thermal transfer through the slots 46. Thus, a tight fit is desirable to reduce thermal transfer. The slots 46 are advantageously blocked to inhibit concrete from entering or passing through the slot, usually by inserting insulating strips sized to fit in the slots 46, by adhering insulating tape to one or both edges of the insulating strips 26, by applying insulating caulk, or even putting a layer of tape across the top of the slot to block entry of wet concrete.

These slot covering/filling mechanisms may also be applied to the portions of the slots 46 open between any portions of the connectors 28 extending through the slots 46, including any portions of the openings formed by connector loops 30, 32 extending through the slots 46, and any portion of the slot between adjacent loops connector 30, 32, and any reduced slots that may exist if the gussets 34, 36 extend through the slot but do not completely fill the slots.

The size and location of the non-structural gussets and the four non-structural spacing tabs are sized and located to be compatible with the sandwiched insulated concrete element's reinforcements, designed and embedded within the two concrete wythes.

The open configuration of the shear connector's two structural parallelograms is specifically sized, shaped, and assembled to maximize the density of the FG/CF/SPY windings, thus maximizing the highest possible level of composite panel performance under induced service design loads. The angle (see angle "Z" in TABLE 1 below) and the overall dimensions (see dimensions "X" and "Y" in the chart below) are in critical relation to one another, and to the overall structural efficacy of this composite shear connector. Dimension "X" is selected and established by industry standard limits of weight (that of the concrete wythes if the final assemblage is to be moved/lifted), available project space allowances, and industry standard concrete forming systems. Dimension "Y" is selected based on the final assemblage's industry standard handling & placement limitations, and to the shear connector's compatibility with the concrete wythe's structurally required reinforcements (i.e., rebar and mesh sizes and spacing). The angle "Z" (see angle "Z" in the chart below), at its structurally strongest angle, would become as near "zero" as mathematically possible. This "near-zero" angle therefore, becomes impractical based on standard industry limits of materials, labor, and application (angle "Z" noted in the attached "drawing" is approximately 45-50 degrees). A "compromise" dimension for angle "Z" and dimension "Y" is therefore selected to efficiently meet the three initial needs for this shear connector: structural load resistance, standard plant manufacturing abilities, and field/plant placement limitations in the production of the final assemblage(s). See TABLE 1 below for dimensions in relation to each other.

TABLE 1

| DIMENSIONS IN RELATION TO EACH OTHER | | |
|---|---|---|
| "X" | "Y" ± | "Z" Degrees ± |
| 6" | 10" | 45-60 |
| 8" | 12" | 45-60 |
| 10" | 15" | 55-60 |
| 12" | 15" | 55-65 |

Positioning Tabs

Referring to FIGS. 1-5, each short end 30*c*, 30*d*, 32*c*, 32*d* of the first and second connector loops 30, 32 may advantageously have a protruding positioning tab 48 extending outward therefrom, preferably along a straight portion of the short ends rather than at the curved exterior corners. The positioning tabs 48 may extend a distance along axis A-A sufficient to position the connector loop 30, 32 from which the positioning tab 48 extends, relative to a concrete form 50 used to create the (usually flat) surface of the first concrete panel or wythe 22. The positioning tabs 48 are shown as curved surfaces the same thickness as or slightly thinner than the short ends 30*c*, 32*c*, 30*d*, 32*d* from which the positioning tabs preferably extend.

Positioning tabs 48 may extend outward from the short ends 30*c*, 30 in the same common plane as the gussets 34, 36 and connector loops 30, 32 to position the shear tie connector 28 relative to a form into which concrete is poured to form the first or second concrete layer/wythe 22, 24. The positioning tabs 48 could extend more from the portion of the longer sides 30*a*, 30*b*, 32*a*, 32*b* however, that is not believed as desirable. Other configurations may be used for the positioning tabs 48 including posts or structures with openings to allow passage of concrete to further embed the shear tie connector 28 in the concrete layers while it is still sufficiently fluid to enter the openings formed by the connector loops 30, 32.

Insertion of Shear Tie Connectors in Concrete Wythes

In use the end of the shear tie connector 28 with the first short ends 30*c*, 32*c* may be inserted into a first layer 22 of concrete while it is still plastic with the positioning tabs 48 abutting the concrete form to position the shear connector tie 28 at a predetermined distance from that concrete form and hence at a predetermined distance from the resulting surface of the concrete when the first layer has hardened and the form is removed. Similarly, in use the end of the shear tie connector 28 with the second short ends 30*d* 32*d* may be inserted into a first layer 22 of concrete while it is still plastic with the positioning tabs 48 abutting the concrete form to position the shear tie connector 28 at a predetermined distance from that concrete form and hence a predetermined distance from the resulting surface of the concrete when the first layer has hardened and the form is removed.

The openings formed by connector loops 30, 32 are larger than in the conventional fiberglass connectors, making it easier for concrete to entrain the connector loops. The opening formed by the wider end of the V-shaped shear tie connector is also considerably larger than the openings in the conventional fiberglass connectors. The larger openings make it easier to accommodate the placement of rebar, reinforcing mesh, and other members placed in the concrete wythes. Moreover, the curvature of the gussets 34, 36 are believed suitable for aiding in positioning the shear tie connectors 28 relative to concrete strengthening members or other items entrained in the concrete layers-especially items with sides having a curvature similar to the curvature of the corresponding edge of the gusset Once one end of the shear tie connector 28 is embedded in the first concrete layer 22, the exposed positioning tabs 48 on the non-embedded end of the shear tie connector may be used to help define the location and thickness of the exterior surface of the poured second concrete layer 24. Alternatively, the non-embedded positioning tabs 48 may be entirely or partially removed if it is desirable to have the concrete surface of the second concrete layer 24 closer to the shear tie connector than permitted by the original distance provided by positioning tabs 48. A weakened fracture line 49 reducing the thickness of the positioning tabs 48 at the juncture with the connector loop 30, 32 from which the tabs extend may be used to facilitate manual removal of the positioning tabs 48 by breaking them off at the location of the fracture line. The location of the fracture line 49 may be varied to provide the desired (reduced) distance, and a plurality of fracture lines may be provided on the positioning tabs 48 if a plurality of lengths of the positioning tabs is desirable as the tabs may be broken off at different fracture line to achieve different distances to the distal end of the positioning tab.

Panel Manufacturing

Referring to FIGS. 3-5, in order to manufacture the sandwich wall panel 20 using the V shear tie connector 28, a concrete form 50 is used to form a first large surface of the first concrete layer 22. The bottom concrete wythe 22 is poured into/onto the form 50, which also has sides to define the thickness and shape of the first concrete layer or wythe 22. Next, a plurality of strips of rigid insulation material 52 are laid on the top surface of the first (bottom) concrete layer 22 to form insulation layer 26. The V shear tie connectors 28 are placed, or plunged, into the exposed surface of the still plastic concrete layer 22 through gaps 52 between the insulation strips 52. If the narrow end of the V shear tie connectors 28 are inserted into the first concrete layer then care should be taken to make sure that the first short ends 30*c*, 32*c* and associated corners 38*a*, 38*b* and 40*a*, 40*b* are wholly disposed into the first concrete layer 14. The chairing legs 35 are advantageously placed over any rebar or other concrete strengthening member 37 in the concrete as specified in the design criteria for the insulated sandwich panel 20. The shear tie connectors 28 are pushed into the first concrete surface until positioning tabs 48 on connector 28 abut the outward facing surface of the concrete form 50 and facilitates gauging the depth of the first short ends and associated corners when the positioning tabs are in contact with the surface of the concrete form 50 to insure a positive and correct depth placement of the connectors 28.

Advantageously, the gaps or slots 46 between the insulating strips 52 may be taped or otherwise blocked by tape, filled with narrow strips of insulating material, or filling the gaps with insulating caulking to reduce thermal transfer through the gaps needed to accommodate passage of the portion of the connecting loops 30, 32 pressed into the plastic concrete surface of the first concrete layer 22. Additional material, tape or caulking may be applied around the periphery of the elongated legs 30*a*, 30*b*, 32*a*, and 32*b* of the first and second connector loops 30, 32 that extend through those gaps, but the gaps are advantageously about the same thickness as the thickness of the connector loops passing through those gaps so there is little space for thermal transfer and the thermal leakage is thus small at the location where the connector loops are immediately adjacent the insulating layer.

The greater source of thermal conduction may arise from any unfilled gap between the elongated sides 30*b*, 32*b*, and from the open gaps formed between each opposing elongated side 30*a*, 30*b* of the first connector loop 30 and 32*a*, 32*b* of the second connector loop 32. The gap between those parts may advantageously filled as discussed above-before the second layer of concrete 24 is poured. Further, a gusset, such as the second gusset 36, may be located to coincide with the location of the insulating layer 26 when the positioning tabs 48 abut the concrete form 50, with the dimensions of that gusset selected to fill as much of the gap as practical.

After optionally filling or taping accessible gaps in the insulation layer 26, the second concrete layer 24 is then poured onto the top or outward facing surface of the rigid insulation layer 26 and the exterior surface of the second concrete layer finished as desired. Care must again be taken to insure the first and second short ends 30*d*, 32*d* of the connector loops 30, 32 are wholly disposed within the top surface of the second concrete layer 12. Advantageously, if positioning tabs 48 are fastened to or adjacent to the first and second short ends 30*d*, 32*d* then the concrete surface advantageously covers those positioning tabs 48 and at least covers the adjacent edge of the short ends 30*d*, 32*d*. Alternatively, the tabs 48 may be broken off along the fracture line 49.

After the concrete layers 22, 24 are sufficiently cured the completed concrete and insulated sandwich panel 20 may be used, with the shear tie connectors 28 helping to hold the layers together while reducing conduction from one concrete layer to the other, thus avoiding, for example, cold-spots from appearing on interior panels in winter at the location of the shear tie connectors 28.

Strand Material Considerations

The elongated strands 42 of the first and second connector loops 30, 32 are preferably formed of a thermally non-conductive material, such as fiberglass filaments, or carbon fiber filaments or synthetic polymer filaments. The materials used to form the elongated strands 42 are advantageously not metallic and have a very low thermal conductivity in order to attain the desired thermal properties of low thermal conductivity. The coefficient of thermal expansion of the connector loops is advantageously about the same as the expansion coefficient of the concrete sheets in which the connector loops are embedded.

The plurality of dry fiberglass filaments are referred to in the trade as roving and the binder or binding agent 43 is typically a vinyl ester resin, however other resins may be suitable. The fiberglass filaments and wetted and wiped (and cured) strands 42 are lower cost, however stretch more than the other types of filaments and strands discussed herein and they also have lower breaking strength than the carbon-resin strands described herein.

The plurality of dry carbon filaments are referred to in the trade as tow, and a suitable binder 43 includes resins, preferably a vinyl ester resin. The carbon fiber filaments are more expensive however produce cured strands that are stronger than strands of fiberglass or synthetic polymer, and which will stretch less than fiberglass, but will also break or fracture when overstressed.

The plurality of dry synthetic polymer filaments are referred to in the trade as yarn, with the same type of resin binders 43 believed to be suitable for use with the yarn as with the fiberglass and carbon filaments. The synthetic polymer fibers and resulting wetted and wiped synthetic (and cured) polymer strands 42 are tougher than the carbon or fiberglass ones and have high fatigue strength, but they have low strength and will undergo considerable stretching, but are difficult to break. Depending on the specific design criteria which is usually based on the loads expected to be exerted on the insulated concrete panel, and depending on the cost, different filaments and their resulting strands 42 may be used to create the matrix 44 and connector loops 30, 32.

Strand Width & Winding Considerations

Referring to FIGS. 6-8, the shear tie connector 28 is advantageously formed of a dry strand 58 having a generally rectangular cross-section with a width W and thickness T and with the length of the dry strand wound around a supply spool 60. Advantageously, the strand width W corresponds to and is preferably about the same as the thickness of the cured shear tie connector loop 30 measured orthogonal to the plane containing the parallel sides (e.g., 30*a*, 30*b*) and short ends (e.g., 30*c*, 30*d*) of the parallelogram-shaped connector loop. This strand width W corresponds to the dimension of the long side of the strand's rectangular-cross-section as shown in FIG. 8, while the strand's thickness T is the dimension of the short side of that cross-sectional shape of a single strand (e.g., 58). In short, width Wis the width of the strand's rectangular cross-section while the thickness T is the thickness or height of that single strand's rectangular cross-section. Dimensions other than those listed in Table 1 may be suitable for the same or different applications-especially as the design requirements may differ.

Thus, a single dry strand 58 advantageously has a rectangular cross-section with a width W and a thickness T, with opposing edges a distance W apart and opposing flat faces a distance T apart. The wetted and wiped strand 58*c* has a thickness of about 1.2 T and a width of about 1.1 T. Viewed slightly differently, dimension T is the thickness of a single winding measured outward from the mandrel 70 and that dimension corresponds to the longer side of the rectangular cross-section of the connector loop 30, 32 during use as the loop includes the thickness of a number of stacked strands, and that longer side lies in the plane of the connector loops 30, 32 and the plane of the shear tie connector 28. The width W of the strand and of the wound stack of strands forming the connector loop 30, 32 remains the same and is defined by the space between adjacent fenders 72

Winding the wetted and wiped strands 58*c* around the mandrel may squeeze out some of the binder 43 and result in a slightly smaller strand thickness. This is especially so at the corners forming acute angles, where the strand density may increase to about 88-92% of the matrix 44. Advantageously, the width of the wetted and wiped strands 58*c* is the same as or slightly less than the spacing between the adjacent fenders 72 between which the strands are wound so that any lateral wandering of the strands 58*c* along a direction parallel to the rotational axis M-M (i.e.-toward one of the fenders 72) or wobble of the rotating mandrel does not cause the wound strands to cup or climb up one or both sides of the fenders 72 (e.g., 72*a*, 72*b*) between which the strands are wound.

Preferred dimensions of the strands 42 are given in Table 1. Referring to FIG. 1, 5 and Table 1, the dimension X is the total thickness of the sandwiched panel 20. The dimension Y is the total maximum in-plane width of the shear tie connector 28 (e.g., exterior side of interior corner 38*c* to the exterior side of interior corner 50*d*). Dimension A is the angle of the acute corners of the shear tie connector (corners 38*b*, 38*d*, 40*b*, 40*d*). Dimension B is the angle of the obtuse corners (corners 38*a*, 38*c*, 40*a*, 40*c*).

As noted, advantageously, the spacing between adjacent fenders 72 (e.g., 72*a*, 72*b*) on opposing ends of the mandrel 70 (e.g., 70*a*) is about the same the width of the flat, wetted and wiped strand 58*c*. If they are identically the same, the wetted and wiped strands 58*c* are bound by resin 43 along the abutting flat faces of each strand while the edges of each strand have a very thin (or no) resin and that will result in little or no flash formed by the excess binder that does not fit in the space bounded by the mandrel 70*a*, fenders 72*a*, 72*b* and filled by the wound strands 58*c*/42. However, there is usually some excess resin 43 and that excess resin forms flash (with thin, sharp edges) and that flash is typically removed.

Thus, the actual spacing between the adjacent fenders 72*a*, 72*b* is slightly smaller than the actual width of the strand 58*c*, and is wound even though the width of strand 58*c* may be slightly larger than the spacing between the adjacent fenders (e.g., 72*a*, 72*b*) bounding the mandrel 70*a* on which the strand 58*c* is being wrapped. The closer spacing on the adjacent fenders 72*a*, 72*b* may wipe off some of the binder on the thin edges of each strand and that will help remove flash adhering to the cured strands. Using steel fenders or coating them with release agents can reduce or minimize binder 43 sticking to the fenders 72. It is thus believed suitable to have the spacing between adjacent fenders 72 (e.g., 72*a*, 72*b*) be slightly smaller than the actual width of the wetted and wiped strand 58*c*, and that may also cause a slight cupping of the strands outward, away from the rotating mandrel 70 as the strands are wound around the mandrel 70 because the binder on the side edges of the strand will slightly stick to the abutting fender 72 during winding.

If insufficient tension is applied to the strand during winding, then the strand's width will also cup from its desired flat, rectangular orientation (usually in a radial direction away from the mandrel) and if little or no tension is applied the strands may cup into a circular cross-section with overlapping ends, or cup into orientations between those two extremes. Slight cupping at the side edges of the flat strand is believed acceptable as long as the strands form a consistent stack of the desired height that has substantially parallel or substantially uniformly shaped strands producing a strand 30, 32 having a rectangular cross-section in the plane along the rotating mandrel axis M-M. The "height" of the stack of strands 58*c* corresponds to the width of the elongated legs and short ends of each connector loop when measured in the plane containing loops 30, 32.

If the fenders 72 are spaced too far apart (wider than the width of the winding fiber/tow/yarn fiber), then slight lateral movement of the wetted and wiped strands 58*c* during winding will likely cause the strands to cause finite gaps between adjacent to one or both of the fenders or allow the winding fiber to "ride" up onto the side of one fender resulting in a cupping toward the mandrel adjacent each abutting fender with a higher center on the stack of strands. This is also undesirable, but acceptable if the strands form a consistent stack of the desired height that has substantially parallel or substantially uniformly shaped strands producing a strand 30, 32 having a rectangular cross-section in the plane along the rotating mandrel axis M-M. The "height" of the stack of strands 58*c* corresponds to the width of the elongated legs and short ends of each connector loop when measured in the plane containing loops 30, 32.

Further, if the fenders 73 are too far apart compared to the width of the wetted and wiped strand 58*c*, then strands may also wander from side to side too much and one side-edge of the strand will overlap the strand underneath while the opposing side-edge falls into the gap between the adjacent fender and the increasingly high stack of strands-resulting in an inclined segment along at least a portion of the stack's periphery which causes that inclined segment to slide toward the adjacent sidewall. When the next strand overlaps that inclined strand, it slides even more so that one sideways inclined strand can cause successive strands to become inclined and slide toward that sidewall. The inclination may vary around the periphery of the winding as the winding occurs. This results in weaker strands and weaker connector loops 30, 32.

As noted, wetted and wiped strands 58*c* with a width smaller than the spacing between the fenders 73 (e.g., 73*a*, 73*b*) can cause the strands to cup or curve upward or outward in a direction radial to the mandrel, with the cupping increasing with as each successive strand is wound on top of the lower strand to form a stack. The outermost strand or strands may be so tightly cupped or curved as to have opposing sides of the strand overlap and form a tube which, when the binder cures, is hard and sharp. It is believed acceptable to remove the outer periphery of such sharp, cupped/tubular strands to make handling easier for installation of the resulting connector loops into the concrete wythes. Abrasives, such as grinding or sanding, are suitable to remove sharp peripheral ridges or edges while removing little material, preferably removing less than 5% of the stack height and more preferably removing no more than the outermost few layers of strand(s).

Still referring to Table 1, the angle "A" is the acute angle between the straight portions of the first elongated leg 30*a* and second short leg 30*d* may vary from about to 60 degrees but is preferably about 45°. This angle "A" is varied as the height of the shear tie connector (measured parallel to axis A-A between short ends 30*c*, 30*d* and short ends 32*c*, 32*d*) is sized to meet the requirements determined by the overall thickness of the concrete and insulation sandwich panel 20. The ability to reduce the thickness of the first and second connector loops 30, 32 and thereby narrow the slot 46 in the insulation layer, also offers a smaller cross-section to shield against heat transfer through those slots that are formed to accommodate passage of the smaller cross-section of the connector loops. Thus, a connector 28 that is stronger than the conventional connectors may be provided with a narrow 3/16" width to decrease thermal transfer, while the overall height and length dimensions/angles are held to functional minimums.

While Table 1 provides information for preferred embodiments, the required thickness or cross-sectional area of the connector loops 30, 32 may be wound to meet the calculated load conditions expected or required to be encountered for the final overall concrete panel 20, resulting in various different combinations height, width, thickness, angle, and loop opening size as well as variations in the fiber strands 42 and resin bound into matrix 44.

Strand Formation & Connector Loop Winding

The machine-based fiber winding and assembly mechanism and process described herein may be used to strength form, shape, size, wind, and bind the fiber strand elements into the improved loop configuration of connector loops 30, 32. Advantageously, the strands are under tension during winding and advantageously a substantial portion of that winding tension is retained after manufacturing when the binder cures so that the wetted, wiped and wound strands 42 form a stiff and strong matrix 44.

Referring to FIGS. 6-9, a simplified strand winding process is shown to illustrate the preferred method for winding a wetted and wiped strand or strands 58*c* (which when cured is strand 42) to form the connector loops 30, 32. The process is described using carbon tow to form strands 42, but the same process may be used for fiberglass roving or synthetic yarn to form the strands. The winding advantageously uses a continuous, flat strand 58 of dry carbon tow, impregnated with a suitable binder 43 (e.g., resin) to form a resin impregnated strand 58*b* that is sized and simultaneously wiped to remove excess binder and form wetted and wiped strand 58*c*, which is then wrapped under sufficient tension onto a mandrel 70 to hold the binder-impregnated strand in the preferred flat shape while the strand is wound between adjacent fenders 72 in a preferable single column configuration to form a radial stack of flat, cured strands 42 for the connector loops 30, 32.

The wetted and wiped strand 58*c* is very similar to but slightly different from the cured strand 42 in the matrix 44. Strand 58*c* is not cured and strand 42 is fully cured. Because the wetted and wiped strand 58*c* becomes the strand 42 in the matrix 44 when the binder 43 cures, the above and following description can also be viewed as having a plurality of filaments in a single, elongated strand wound on the spool 60, then wetting that strand of filaments with binder 43 to produce wetted strand 58*b*, then wiping that wetted strand to remove excess resin and further define the size and/or shape of the strand's cross-section to produce wetted and wiped strand 58*c*-which when wrapped around mandrel 70 and cured, results in cured strands 42 (or cured strands 58*c*) bound in matrix 44. The rotating mandrel 70 winds the strands 42 (or winds the wetted and wiped strands 58*c*) into the desired shape of the connector loops 30, 32.

In more detail, industry-standard, carbon fibers are shipped wound around spool 60 in the form of a single, continuous strand of dry, flat tow 58 in which the single tow may contain hundreds or thousands of individual filaments which are typically made of graphite. The preferred dry tow 58 as shipped advantageously has a cross-section that is generally rectangular with rounded corners, and preferably about the same width W as the spacing between adjacent fenders 72 (e.g., 72*a*, 72*b*) which corresponds to the intended thickness of the resulting connector loop 30, 32. For concrete shear tie connectors 28 a desirable thickness of the connector and a desirable width of the dry tow 58 is about 3/16 inch wide (about 0.19 inches or about 4.8 mm) and a few thousandths of an inch high. The shapes and dimensions may vary. A strand width of about 5/16 inch is also believed desirable.

The dry tow 58 is drawn under tension through the strand processing (usually vertically downward). The tension is illustrated as being determined in part by a spring-loaded roller located in the path of the tow 58 to resiliently divert that path an amount sufficient to create the desired tension. The tension is also created by the mandrel 70 rotating about axis M-M at a defined rotation and torque to wrap the wetted and wiped tow around the mandrel as described below, but the spring-loaded roller of the tension mechanism helps set the resulting tension as the tow 58 is pulled through the processing stations and onto the mandrel. Other tension mechanisms may be used.

The wetting station has a wetting outlet orifice 64 having the same shape as the dry tow 58 (e.g., rectangular) with about the same width as the dry tow 58 but about twice the thickness of the dry tow. The wetting outlet orifice 64 helps force some of the resin into the tow (and force air out) and helps ensure ample wetting of the dry tow while reducing excessive loss of resin or binding agent 43 through excessive coating by the resin. The travel rate of the tow through the wetting station is slow enough to allow the resin or other binding agent sufficient time to impregnate or wet the previously dry tow with an amount of resin (or other binder) sufficient for its intended use. The preferred resin is air curable with the curing rate increasing as the temperature increases and as the amount of hardener. Thus, the overall process of wetting, wiping and winding to form the connector loops 30, 32 must be completed in a defined time, with a time of 15-20 minutes believed suitable for the binder 43 to be cured. Longer curing times may be used, however, times greater than 30-40 minutes are usually unacceptable because of production considerations and because most cure methods result in a degraded product (e.g., lower strength and hardness) if the cure time is too long.

The wetted tow 58*a* is then pulled through a wiping station 65 which has a wiping orifice 66 through which the tow is pulled, and a reservoir 67 for receiving and containing excess resin wiped off of the wetted tow 58*a* by the wiping outlet orifice to produce tow strand 58*c* that is wetted and wiped and which, when dried, forms elongated strand 42. The wiping outlet orifice 67 may have a width about the same as the width of the dry tow and a height about 1.2 time the thickness or height of the dry tow. The wiping outlet orifice 67 may include a nozzle with a slot dimensioned the same as the desired width of the raw tow 58 (and the desired width of the cured strand 42) and about 1.2 times the thickness of the raw tow 58. The increased thickness accounts for some loss of resin during the remaining process steps.

The wetted and wiped tow strand 58*c* advantageously passes over one or more positioning guide members or (preferably) rollers 71 which are usually fixed in position to align the strand 58*c* with a general location on the mandrel 70. The rollers or guide members advantageously have curved or rotating surfaces to control the potential removal of resin as the strand 58*c* passes over those members or rollers 71. Passage over a roller may reduce resin removal while passage over a curved member (or an edge on the member) may scrape off or otherwise remove resin. The positioning guide members 71 are usually fixed in place.

The wetted and wiped tow strand 58*c* next passes across a guide finger 68 or through a guide ring 68 (such as a D ring) and onto the mandrel 70. The guide finger and guide ring 68 is preferably movable along an axis perpendicular to the plane of FIG. 6 by a translating mechanism (e.g., cam mechanism, rack and pinion or electric motor) to provide limited motion to the wetted and wiped tow strand 58*c* onto one or more different mandrels each of which is preferably bounded by a pair of fenders 72 (e.g., fenders 72*a*, 72*b*).

In the described configuration there are plural mandrels ganged together about a common rotational axis M-M of the ganged mandrels, with a fender on each side of the mandrel. The described embodiment has first and second mandrels 70*a* and 70*b* respectively, with each mandrel bounded by a fender 72 on each opposing side of the mandrel. Thus, the first mandrel 70*a* has bounding first and second fenders 72*a*, 72*b* on opposing sides of that first mandrel, and the second mandrel 70*b* bounded by second and third fenders 72*b* and 72*c*. The number of mandrels (and bounding fenders) may be increased as reflected by the second mandrel 70*b*.

The control finger or guide ring 68 is thus interposed in the line of travel between the wiping station 65 and the first mandrel 70*a*. The control finger or guide ring 68 would move into and out of the plane of the schematic illustration of FIG. 6 by a mechanism not shown, but which would be known to or readily devised by a person of ordinary skill in the art of winding strands. The first mandrel 70*a* may be rotated about mandrel axis M-M, preferably by an electric or hydraulic motor (not shown) at a rotational rate that may be varied automatically or manually, and preferably has a slip clutch that may additionally and optionally be used to control the tension in the strand being wound on the mandrel. A stepper motor is also believed useful as it may rotate continuously, but in predetermined angular increments.

The first mandrel 70*a* is configured to have an outward facing surface or periphery that conforms to the shape defined by the inside surface of the first and/or second connector loops 30, 32, as each of the ganged mandrels forms that shape on the wetted and wiped strands 58*c* wound about that mandrel. The mandrel 70 or ganged mandrels 70*a*, 70*b* etc., may be rotating or non-rotating when the first wetted and wiped tow strand 58*c* is attached, and because the mandrels are mounted on a common rotational axis M-M either all mandrels rotate together, or stop together.

If the mandrels are ganged, then advantageously a plurality of the fenders 72 may have a notch or slot 73 extending from a periphery of the fender to the mandrel so that the wetted and wiped tow strand 58*c* may be passed through the slot 73 (FIG. 9A) to contact and removably adhere to the mandrel at the base of the notch. If the resulting connector loops 30, 32 (on opposing sides of the fender having the slot) are to be left connected by the strand passing through that slot, then the slot is advantageously formed on one of the acute corners of the mandrel. As the wetted and wiped strand 58*c* passes through the slot it bends at a right angle (90*d* degrees) to pass through the slot to an immediately adjacent mandrel. The right angle bending of the wetted and wiped tow strand 58*c* from the slot 73 to the circumferential winding about the immediately adjacent mandrel holds the tow strand 58*c* in place sufficiently long for the tow to be engaged by that adjacent mandrel and wrapped around that mandrel. Thus, each of the fenders 72*a*, 72*b* and 72*c* advantageously have respective notches 73*a*, 73*b* and 73*c* formed therein-which may allow the wetted and wiped strands 58*c* to pass through the fender 72 on either side of the mandrel 70 between those fenders so the "next" mandrel and winding may be to the right or left of the initial mandrel.

It is believed that the slot or notch 73 may be located anywhere along the periphery of the fender 72 in which the slot is formed. If the resulting connector loops 30, 32 (on opposing sides of the fender having the slot) are to be left connected by the strand passing through that slot, then the slot is advantageously formed on one of the acute corners of the mandrel.

As best seen in FIGS. 6-9, rotation of the mandrel 70 winds the wetted and wiped tow strand 58*c* onto the mandrel where it cures to form strands 42 with the resin 43 binding the wound strands together to form matrix 44 when the binding resin cures. However, when the wetted and wiped tow strand 58*c* is initially wrapped around the first mandrel 70*a* it is not yet cured, and may be removed for curing by air drying after the resin has set enough to allow removal but is still stiff enough to maintain the desired shape imparted by winding about the mandrel. A release agent may be applied to the mandrel before winding to facilitate removal of the wound connectors 30, 32 after winding is terminated, whether the resin is fully cured or not.

When the desired number of layers of the wetted and wiped tow 58*c* are wound around the mandrel 70*a*, the winding may stop by stopping rotation of the mandrel(s). Alternatively, the wetted and wiped tow strand 58*c* may be guided by the guide ring or guide finger 68 into the slot 73*b* (FIGS. 6 & 9) in the second fender 72*b* to engage the second mandrel 72B sufficiently to begin wrapping around the second mandrel 72*b* where the above-described wrapping process is repeated. It is advantageous to have the last wetted and wiped tow strand 58*c* of the outermost layer or stack of tows end adjacent the fender having the slot 73, and preferably to end immediately adjacent that slot 73 so that tow can be passed through the immediately adjacent slot 73 to pass through that notch and onto the next adjacent mandrel. If the next adjacent mandrel is not going to be wrapped then the wetted and wiped strand of tow 58*c* may be temporarily tied-off for removal of the tow wound around the last mandrel which forms the desired connector loop 30, 32. The location of that last tow or strand 58*c* in the outermost layer may be predetermined when designing the layup of the tows which result in the connector loops 30, 32—again with the wetted and wiped tow layers cured to form the wrapped and stacked layers of strand(s) 42 in matrix 44 configured to form connector loops 30, 32.

Thus, the fenders 72 are advantageously provided with crossover notches or slots 73 in the outer edge(s) of each winding guide fender, in phase, at predetermined locations to facilitate the continuous winding feed transition from one completed yarn loop count (which when cured forms connector loops 30, 32) onto the next immediate/successive loop winding mandrel through and across each successive winding guide fender crossover notch or slot 73, without interruption. Thus, the crossover of the wetted and wiped fiber strand 58*c* from one mandrel 70*a* to another mandrel 70*b* through the notch or slot 73 does not appreciably interrupt the continuing winding turning rate (RPM), the winding tension, the feed guiding (e.g., by finger/ring 63), yarn wetting or yarn wiping.

The crossover notches or slots 73 are advantageously configured (including size, shape, and angle) and formed at locations in the fenders 72 so they are in phase with the rotation rate of the turning winding mandrel assemblage such that when a specified number of layers and/or wetted and wiped fiber strands 58*c* are wound on the first mandrel 70 then the last strand is adjacent to the slot and that fiber strand may be moved through the slot onto the mandrel on the opposing side of the slot and the opposing side of the fender in which that slot is formed.

The notch or slot 73 is preferably slightly larger at its distal, open end and tapers to a smaller closed end adjacent the mandrel 70 onto which the wetted and wiped strand 58*c* is to be wound. The notch or slot 73 extends generally along an axis radial to the mandrel rotational axis M-M and in the plane of rotation of the fender in which the slot is formed. Advantageously, the leading rotational edge of the slot extends along that radial axis. The slot 73 extends through the fender 72 and has opposing slot faces which are generally parallel to each other but inclined relative to the plane of rotation about axis M-M in a direction toward the adjacent mandrel onto which the wetted and wiped strand 58*c* is to be wound. An inclined angle of about 30° to 60° is believed suitable, with 30° being preferred. The trailing edge of the slot 73 and the trailing slot face catch or snag the wetted and wiped strand 58*c* as the guide finger or guide ring 68 moves laterally generally parallel to the mandrel rotational axis M-M in a direction to transfer or step the fiber strand 58*c* onto the successive positioned winding mandrel 70 (e.g., from 70*a* to 70*b*) without interruption of the fiber strand 58*c* feed and without interrupting the rotation/turning rate of the wetting, wiping and winding assemblage. If the angle is too sharp for the rotational speed then the strand may be cut. If the angle is too large for the rotational speed then the strand may not be moved into the slot when intended.

The notch or slot 73 may thus be considered a crossover winding slot as it helps cause the fiber strand 58*c* to cross over the fender 72*b* separating the first mandrel 70*a* from the second mandrel 70*b*. Depending on the direction of rotation about axis M-M and the transverse direction along axis M-M in which the wetted and wiped strand 58*c* is to pass through the fender 72 bounding one side of the stack of wound strands 58*c*—the orientation of the slot inclination may change. However, the slot is orientated so that the trailing edge and trailing face of the slot 73 catch the wetted and wiped strand 58*c* when that strand is moved along axis M-M by the guide finger or guide ring 68, so the faces of the slot guide that strand onto the adjacent mandrel so another connector loop 30, 32 can be wound on that adjacent mandrel.

The depth of the crossover winding slot 73 preferably extends from the outer periphery of the fender 72 being crossed-over (e.g., fender 72*b*), to a depth equal to that of the adjacent winding mandrel 70*b*. The width of the bottom (i.e., closest to the adjacent mandrel such as 70*b*) of the crossover slot 73 is design matched to the specified fiber cross section size/dimension. As the preferred (and illustrative) dry strand or tow or roving 58 has a width of about 3/16 inch and the wetted and wiped fiber strand 58*c* is about the same width, the width at the bottom of the crossover winding slot 73*b* at the location of the second mandrel 70*b* is also about 3/16th inch. Other angles of inclination are believed suitable for the slot(s) 73 through the fender.

It is believed that a protrusion extending outward from the face of the fender 72 adjacent the crossover slot 73 could also be used to catch the wetted and wiped strand 58*c* when the stack of wound strands reaches that protrusion, so the protrusion can help guide that strand into the slot so the strand can engage the strand and pass it through the slot to be wound onto the adjacent mandrel 70 (e.g., from mandrel 70*a* to 70*b*). Using a protrusion to guide the strand into the slot likely requires winding the strands 58*c* to a predetermined height (measured radial from the outer surface of mandrel 70) determined by the location of the protrusion relative to the outer surface of the mandrel. That may avoid or reduce the use of or reliance on a guide ring or guide finger 68, or it may be used in conjunction with the described inclined slot 73 as a limit on the height of the wound strands 58*c*.

Referring to FIG. 6, a single spool 60 of carbon tow may be pulled onto the mandrel 70 for winding. More than one spool 60 of dry tow, wetting stations 62, wiping stations 65 may produce plural wetted and wiped strands 58*c* that are positioned by positioning fingers or rollers 71 so the resulting wetted and wiped strands 58*c* pass through the same (or different) guide ring 68 (or over guide finger 68) and be guided to simultaneously wrap two adjacent wetted and wiped strands 58*c* around the same mandrel 70 and between the same two adjacent fender 72 (or even through separate mandrels and fenders). Moreover, when the appropriate number of those same plurality of wetted and wiped strands 58*c* are stacked on top of each other in radially parallel stacks the strands 58*c* may be moved by the guide finger or guide ring 68 to pass through the appropriate slot(s) 73 and onto an adjacent mandrel(s), given the disclosure herein.

When the winding is completed, the wound layers/stacks of wetted and wiped tow 58*c* are removed from their respective mandrels 70 by removing any blocking fenders 72 to allow removal of each mandrel and/or removal of the wound tow from its respective mandrel. Any single cross-over strand passing through one of the notches 73 in the fender 72 having that notch may be trimmed/cut, if it is not desired to have the adjacent windings connected by the cross-over strand.

Given the present disclosure, it is believed that one of ordinary skill in the art could readily provide additional variations on winding the wetted and wiped strand(s) 58*c* to form the connecting loops 30, 32 (in various configurations or shapes) and curing them for the uses described herein.

The wound strands 42 in the form of connector loops 30, 32 are removed from the mandrel about which it is wound when it is sufficiently cured to maintain its designed shape, and that advantageously occurs when the winding is completed or shortly thereafter. The wound strands 58*c* continue to cure as they air-dry and thus the wound stack of strands becomes stronger and stiffer as time passes and the resin or binder agent 43 cures to form the matrix 44 entraining the elongated and cured strands 42. As needed, the wound strands may be left on the mandrel until it is cured to a desired stiffness, including leaving the wetted and wiped strands 58*c* on the mandrel 70 until they fully harden.

The binder or binding agent 43 is typically a resin, preferably a vinyl resin which typically uses a two-part mixture requiring the addition of a catalyst to begin the process of curing the resin to form the resulting hardened matrix 44. The amount of catalyst added affects the cure time and adding more catalyst increases the temperature while shortening the cure time. An amount of catalyst sufficient to allow 15-20 minutes before the resin is substantially fully cured, is believed suitable. The connectors 30, 32 are advantageously removed from the mandrels 70 used to form them when the binder resin 43 is fully cured to form matrix 44 of strands 42 and cured binding agent 43, but again, they may be removed before the resin fully cures as doing so exposes more of the surface of connector loops 30, 32 to air and that expedites curing and increases throughput. Thus, there are advantages to removing partially cured strand windings in the form of connector loops 30, 32 from the mandrel and allowing them to complete curing off the mandrel 70.

Moreover, resins 43 are available that may be hardened or cured or set using heat, light (especially ultraviolet light UV), or high frequency sound source-some of which require an environmental controlled chamber to control exposure to the heat, light or sound. Thus, curing of the binder 43 to complete the connector loops 30, 32 may occur by performing the entire wrapping operation in an environmentally controlled chamber or, or may occur by removing the mandrel and fenders with the wound loops 30, 32 on them to an environmentally controlled chamber to complete curing, or may occur by removing the partially cured but sufficiently stiff wound loops 30, 32 from the mandrel(s) 72 and/or fenders 72 and placing the wound loops 30, 32 in the environmentally controlled chamber to complete curing.

Thus, each of the wetted and wiped tow 58*c* is sandwiched between two adjacent fenders 72 which may be located to help control the lateral dimension (e.g., thickness) of that wound strand (and resulting cured strands 42) measured transverse to the length of the mandrel 70 between the two adjacent fenders (e.g., fenders 72*a*, 72*b* or fenders 72*b*, 72*c*) to conform to the desired dimensions of the connector loops 30, 32 when the resin or binder 44 cures. The manufacturing process may also control the width, thickness, and direction throughout winding rotation counts of the wetted and wiped strands 58*c* and thus control the resulting strands 42 when the wetted and wiped strands 58*c* cure to form the connector loops 30, 32.

The resulting connector loop 30, 32 has an open interior with a parallelogram exterior shape formed by the strands 58*c*/42 extending around the entire periphery namely the elongated legs (e.g., 30*a*, 30*b*) and short ends (e.g., 30*c*, 30*d*) joined by the curved corners (e.g., 38*a*, 38*b*, 38*c*, 38*d*). Advantageously, no structural members extend inward from or extend between the elongated legs (e.g., 30*a*, 30*b*) or short ends (e.g., 30*c*, 30*d*). That said a non-structural member, such as a gusset may extend inward from or between the elongated legs (e.g., 30*a*, 30*b*) or short ends (e.g., 30*c*, 30*d*), with the gusset optionally formed of resin having a tensile strength at least one or two orders of magnitude less than that of the tensile strength of any of the elongated legs or short ends (located between the curved corners). Such non-structural gusset is believed to increase handling stability of the shear tie connector 28, while not creating an alternative load path between the concrete wythes 22, 24. Thus, no structural member extends into or across the otherwise open interior bounded by the periphery of the connector loops 30, 32, and any non-structural members extending into or across that interior are neither designed nor made to carry anywhere near the forces or loads exerted on the elongated sides, short ends or corners connecting those parts. The forces transmitted between the concrete wythes by the connector 28 are predominately transmitted by the elongated legs, short ends and corners connecting those parts. A gusset joined to opposing elongated sides or short ends or combinations thereof which is the same thickness as those sides and ends and made of the binder with few if any strands therein, is believed to provide insufficient load carrying capacity (by at least one if not two or three orders of magnitude) to transmit the forces exerted on the concrete wythes by the elongated sides and short ends of the connector 28.

The process illustrated in FIG. 6-7 is suited for batch processing (small or large batch), and for extended or continuous production of the connector loops 30, 32, especially if the wetting reservoir receives a continual supply of resin and catalyst that are kept segregated until mixed (e.g., in a mixing chamber) that is sealed sufficiently between the inlet and outlet such that the mixing of catalyst/hardener with the resin occurs only in the mixing chamber and that chamber is continually purged of the intermixed contents forming the binder 43. Such segregated supplies and sealed mixing chambers are known in the art and not described in detail herein. Mixing tubes with rotating screw or fixed screw mixing elements are known, and may be used for batch processing with the tubes replaced between batches, or may be used for continual processing as long as the mandrels and spools of fiber are available for wrapping.

Increasing Strand Density & Fabrication Time

A greater density of fibers 42 compared to binder 43 should result in a stronger connector loop 30, 32. Making connector loops 30, 32 having a large fiber density in a small amount of time may be achieved if a continuously wound single strand is used to form a single stack of wound wetted and wiped strands 58*c*-which strand has a width about the same as the spacing between the fenders bounding the mandrel about which the strand is wound. Thus, one wetted and wiped strand 58*c* may be added to the stack with each rotation of the mandrel 70.

The resulting connector loops thus advantageously have a single strand 58*c* forming a first loop wrapped around the opposing elongated sides (e.g., 30*a*, 30*b*) and opposing short ends (e.g., 30*c*, 30*d*) of each loop 30, 32 in the same or almost the same radial plane orthogonal to the mandrel axis M-M to form a stack of strands, so each layer in a cross-section of the stack has one strand in it and the stacked layers follow the contour of the mandrel 70 around which they are wound. Alternatively described, a single continuous strand is wound about a first mandrel to form a first loop having a first (parallelogram) shape about which that same strand is wound to form a plurality of successive loops, each successive loop encircling that first loop to form a single stack or single column of strands having the same contour shape as the first strand, each strand having a width bounded on opposing sides of the strand by the adjacent fenders 72 (e.g., 72*a*, 72*b*) which bound the ends of each mandrel 70 or mandrel segment 70*a*, 70*b*, etc. If a notch 73 is placed in one of the fenders 72 then the two adjacent stacks of strands may be connected by the wetted and wiped strand 58*c* passing through that notch which can allow continuous winding of multiple mandrels and thus increase production.

The use of two (or more) strands parallel to each other and winding about the same mandrel axis M-M but around adjacent or different mandrels 70*a*, 70*b* can also be used to simultaneously wind two (or more) stacks of wetted and wiped strands 58*c* as described above. In this situation, two fenders 72 (e.g., 72*a*, 72*b* and 72*b* 72*c* bound each of two mandrels 70*a*, 70*b* to form the preferred stack of strands. That increases production of the connector loops 30, 32.

A stack of strands may also be wound having two (or more) strands parallel to each other to form two (or more) stacks of strands, with each stack in the same radial plane orthogonal to the mandrel axis M-M, and the sides of each stack abutting each other and connected by binder 43. Each layer of strands in each stack is generally concentric. This plurality of parallel strands requires each strand to have a width that is smaller than the space between the fenders bounding the stack of wetted and wiped strands—but with the combined width of the strands in each layer to have about the same dimension as the distance between the two fenders 72 (e.g., 72*a*, 72*b*) bounding those stacks. That assembly leaves a larger volume of interstitial space between strands than the preferred stack formed by a single, wide strand forming the stack. Thus, using more than one fiber in each stacked layer of strands can be used, but doing so increases the interstitial space and decreases the strand density-resulting in connector loops 30, 32 that are not as strong as they could be.

Further, winding strands with smaller cross-sectional sizes takes more time to create a stack of wetted and cured strands 58*c* suitable for use of the desired connector loops 30, 32. Since the binder starts to cure once the hardener is added to the resin and may take only 15-20 or so minutes to cure—the longer winding time for smaller cross-section strands also limits production quantities and increases production costs. The overlapping of broken strands also weakens the strength of the connector loops 30, 32 as it requires the weaker binder to carry the load across the broken fibers.

A usable, and even a less dense winding using a much less time efficient method, would be to wind one or more wetted and wiped strands 58*c* of any cross-sectional shape in a layered pattern using a one or more strands with much smaller cross-section than the preferred rectangular strand. Further, broken if a strand breaks during winding it may be accommodated by overlapping the remaining end of the broken strand with the prior wound stack and then continuing the winding so the binder and overlapping strands hold the broken ends in place. This allows various winding patterns to be used, but the smaller cross-section of the strands increases interstitial spaces and increases the volume of binder 43 while decreasing the strand density.

Mandrel Configuration

Figure 9A:
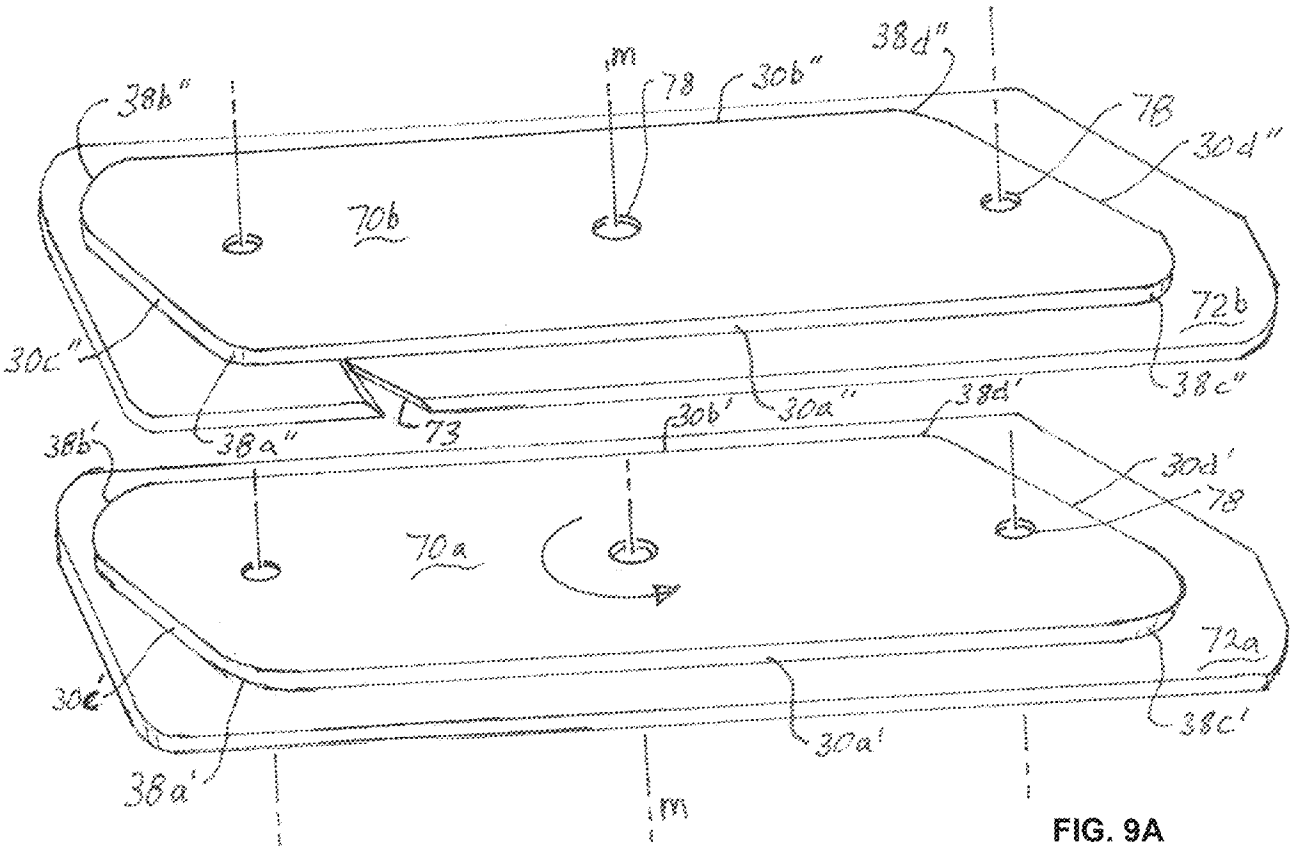
FIG. 9A is an exploded perspective view of two mandrels and three fenders with a slot configured to allow a strand to move from mandrel 70*a* to mandrel 70*b;*
Figure 9B:
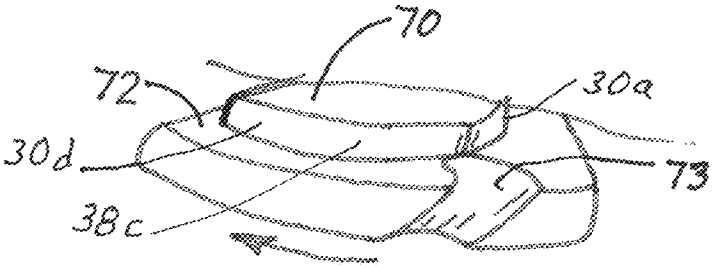
FIG. 9B is an end-perspective view of an angled slot through a mandrel fender.
Figure 9C:
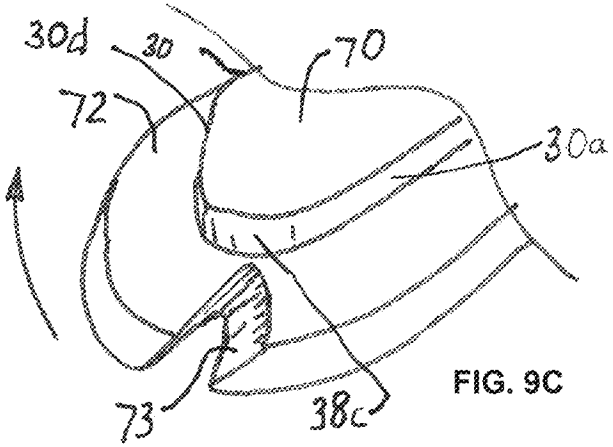
FIG. 9C is a top perspective view of the slot of FIG. 9B.

Referring to FIGS. 1, 6 and 9, the mandrel 70 has the exterior shape desired for the inner periphery or interior side/face of the connector loops 30, 32. By rotating the first connector loop 30 about axis A-A the second connector loop 32 is achieved, so a single mandrel shape 70 may be used to produce both connector loops 30, 32. If different configurations are required for the connector loops 30, 32 then the required number of differently shaped mandrels 70 would be used to produce the required number of differently shaped connector loops. Also, while the preferred embodiment of the shear tie connector 28 has two connector loops 30, 32 with the same construction (e.g., configuration, number of strands 42, material and size of strands, arrangement of strands), different mandrels could be used to produce connector loops of different configurations or perhaps more likely, to produce connector loops 30, 32 having different numbers of strands 42—for use in the same shear tie connector 28. Thus, while the first and second mandrels 70*a*, 70*b* shown in FIG. 9A have the same configuration and the same number, type and arrangement of windings, the mandrels used to make parts of the same shear tie connector 28 need not be the same, and even the same mandrel may be used to make connector loops 30, 32 that differ (e.g., by the number, tension used for wrapping, cross-sectional shape of strands, wrapping arrangement of strands, or type of material used in the wetted and wiped strand 58*c* to produce the resulting strands 42 when the binder 43 cures to form the matrix 44 and connector loops 30, 32.

Referring to FIGS. 1 and 9 to illustrate the surfaces of the mandrels 70*a*, 70*b* that form the corresponding inner periphery of the connector loops 30, 32, surfaces on the first mandrel are labeled with the same number but with an additional single prime (') mark to identify the surfaces of the first mandrel that are used to produce the correspond part of the connector loop 30 (which loop may be rotated for use as connector loop 32 as discussed above). The same numbers with two prime marks (' ') are used to identify those same corresponding surfaces on the second mandrel 70*b*. Thus, for example, first and second elongated connector legs 30*a*, 30*b* are formed on first and second elongated sides 30*a*' and 30*b*' respectively of the first mandrel 70*a*. Those same, corresponding connector legs 30*a*, 30*b* are formed on the second mandrel 70*b* by first and second elongated sides 30*a* and 30*b*. The first and second short ends 32*c*, 32*d* of the connector loop 30 are formed on the first and second short ends 30*c*' and 30*d*' of the first mandrel 70*a*, and formed on the second mandrel 70*b* by first and second short ends 30*c* and 30*d*. The first, second, third and fourth interior corners 38*a*, 38*b*, 38*c* and 38*d* of the first connector loop are formed on the first mandrel 70*a* by corresponding exterior corners 38*a*', 38*b*', 38*c*' and 38*d*' of the first mandrel 70*a*, and exterior corners 38*a*, 38*b*, 38*c* and 38*d* of the second mandrel 70*b*.

The first mandrel 70*a* is placed between first and second fenders 72*a*, 72*b*, while the second mandrel 70*b* is placed between second and third fenders 72*b*, 72*c*. As understood by one of ordinary skill in the art, additional mandrels and fenders may be added to the gang of mandrels, or a single mandrel may be used.

The mandrels 70 and fenders 72 are shown as aligned along three parallel axes which pass through holes 78 in the mandrels and fenders which axes are centered in those holes. The center hole is preferably for the mandrel rotational axis M-M and the two outer holes are used for alignment and holding the mandrel and fenders together. A compression fastener such as a bolt with a head or shoulder on one end and threads on the opposing end may pass through the two outer holes 78 with a threaded nut engaging the threaded bolt head to clamp the mandrel(s) 70 and fenders 72 together during rotation and winding, and to allow removal of the wound connector loops 30, 32 from the mandrel after winding. A similar clamp can be arranged on a drive shaft extending along the mandrel rotational axis M-M by clamping the fenders 72 and mandrels 70 between a shoulder and threaded end of the drive shaft and using only positioning pins in one or both of the outer holes 78 rather than compression fasteners. Other mechanisms for releasably holding the mandrels and fenders together during winding rotation may be used.

The mandrel 70 advantageously provides a continuous support about its periphery to the strands 42 being wound around the mandrel, and thus may include a wood, metal or polymer material having the sides 30*a*, 30*b*, 30*c*, 30*d* joined by curved corners 38*a*, 38*b*, 38*c* and 38*d* formed on the outward facing surface of the mandrel 70. The material forming the mandrel(s) 70 is advantageously selected so it doesn't adhere to the binder 43 so as to facilitate removal of the wound connector loops 30, 32 from the mandrel. Alternatively, but less desirably, a release agent may be applied to the mandrel before winding commences.

If a non-continuous support along the long sides or short ends is used, the same concern about sagging and cupping occurring across any gaps in the support still remains. Additionally, any gaps in the mandrel's support surface would either allow binder to accumulate in the gaps which may cause irregularities in the straightness of the sides and ends of the loop 30, or would require more costly and time-consuming cleaning between uses. Thus, a mandrel 70 providing a continuous support surface for the strands 42 wound around the mandrel is preferred. That said, intermittent supports are believed suitable if they provide substantially straight and substantially flat cured 42 strands in the elongated sides and short ends of the loops 30, 32.

Forming the connector loops 30, 32 by winding them about the mandrel 70 results in a loop having an inner edge that is as flat as the surfaces of mandrel 70 producing those loops. The inner surface of the connector loops 30, 32 is thus straight. However, the outward facing surface or edge (opposite that inner edge) of the connector loops are slightly bulged if they are wound using only tension to maintain the straightness of the strand 58*c* as it is wrapped. That outward facing surface or edge advantageously does not rise above a straight line connecting the corners on opposing ends of the elongated sides (e.g., 30*a*, 30*b*) and short ends (e.g., 30*c*, 30*d*) by more than about 35% the minimum thickness of the corners of the parallelogram (e.g., acute corners 38*b*, 38*c*).

As used herein, the substantially straight wet and wiped fiber 58*c* that cures to form substantially straight strands 43 and elongated sides (e.g., 30*a*, 30*b*) and short ends (30*c*, 30*d*) encompasses strands, sides and ends that are as straight as the mating surface of the mandrel 70 on the inside of the loop (not greater that 95% off straight) and encompass a bow or bulge or curve on the remaining portions of those sides and ends that deviates from a straight line parallel to the straight corresponding portion of the inner periphery of the connector loop by no more than 90% and preferably by not more than 95%, the straightness being measured between the end of the curved corners 38, 40 on the inside of the loops and the corresponding curved corners on the outside of those interior corners.

Strand Tension During Winding

A minimum winding tension of about 8-12 and preferably 10 pounds per strand 42 is believed desirable, with a greater winding tension of about 20 pounds per strand believed usable. Greater winding tensions are believed usable if needed to straighten or flatten the strand as it is wetted, wiped and wound, and are believed to require more expensive and complex winding mechanisms to handle the larger tension force. The lower winding tension is believed sufficient to maintain the wetted and wiped strands 58*c* made of carbon tow (or other material) substantially straight during winding while increasing the fiber density at the connector loop's corners (and squeezing out some binder 43), especially at the acute angle of the preferred parallelogram shape (e.g., corners 38*b*, 38*c*) of the connector loops 30, 32. The same basic process is believed suitable for carbon tow, fiberglass ring or synthetic polymer yarn, but one skilled in the art may optimize it for differences between the described carbon tow and either fiberglass roving or synthetic polymer yarn.

The increased strand density arising from the process described herein results in a shear tie connector 28 that is considerably stronger in tension, along the length of the elongated straight sides and ends of the connector loops. Further, as the winding about acute angles of the mandrel 70 compresses the strands 42 at the corners where higher stresses arise during use, a higher fiber density is provided at the location of the higher stresses.

Mandrel Follower

Figure 10A:
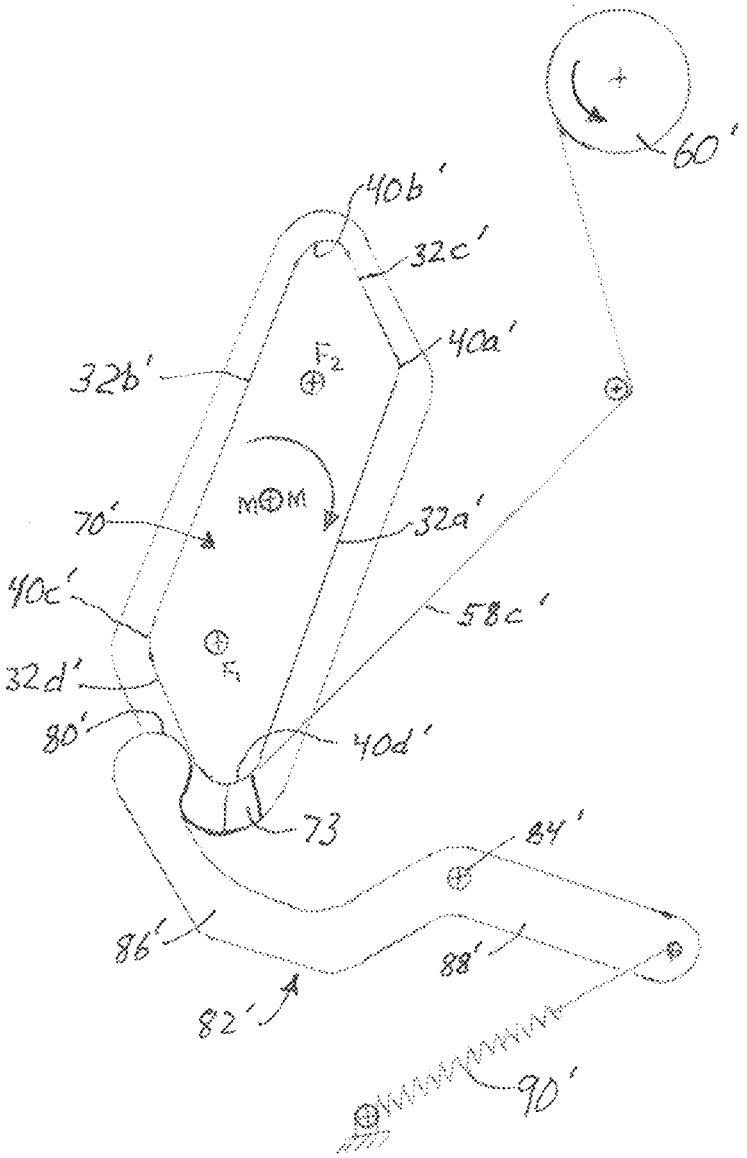
FIG. 10A is a schematic view of a winding mandrel having a follower resiliently urged against the wetted and wiped fiber strand when the mandrel is in a first rotational position.
Figure 10B:
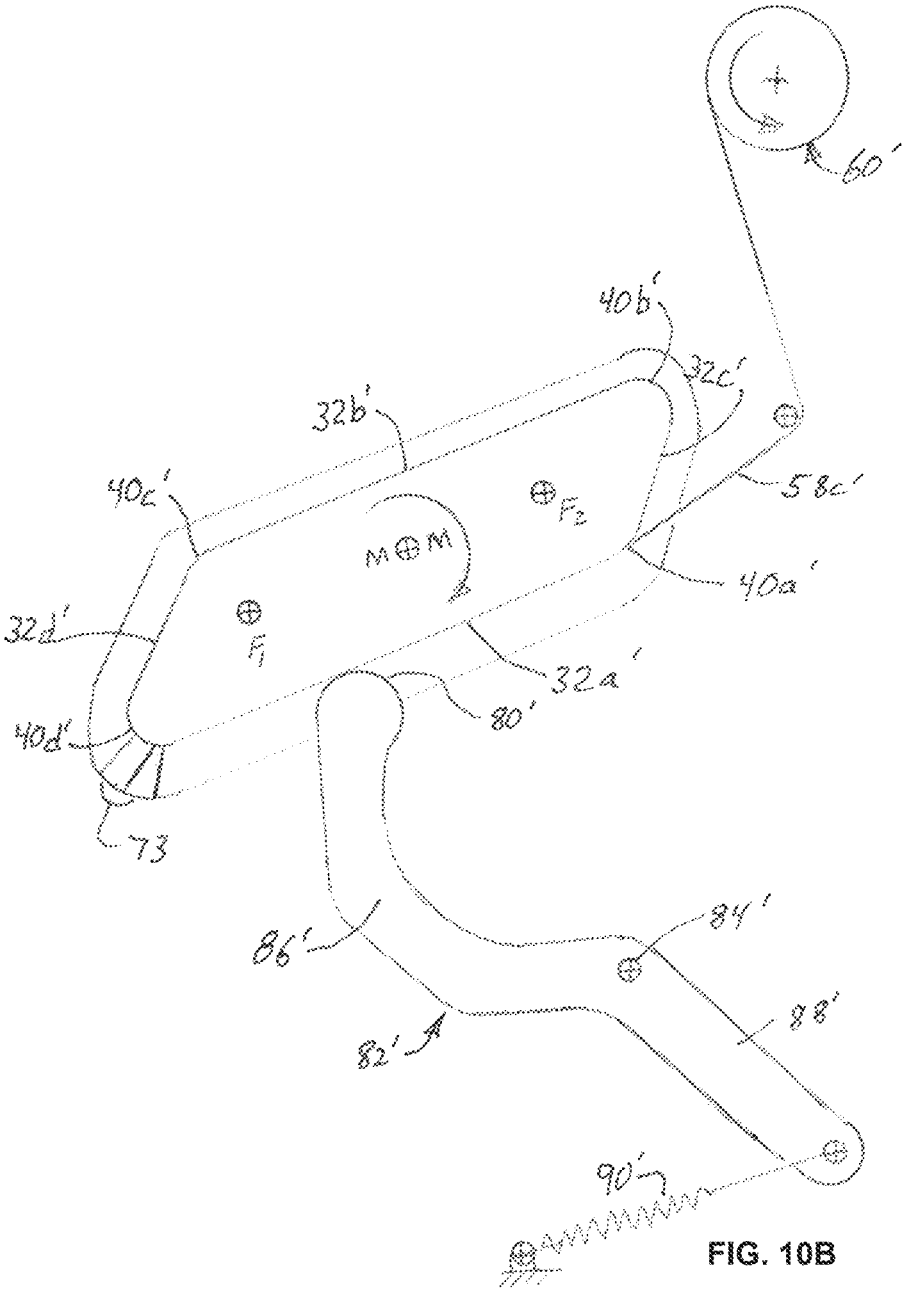
FIG. 10B is a schematic view of a winding mandrel and follower of FIG. 10A in a second position.
Figure 10C:
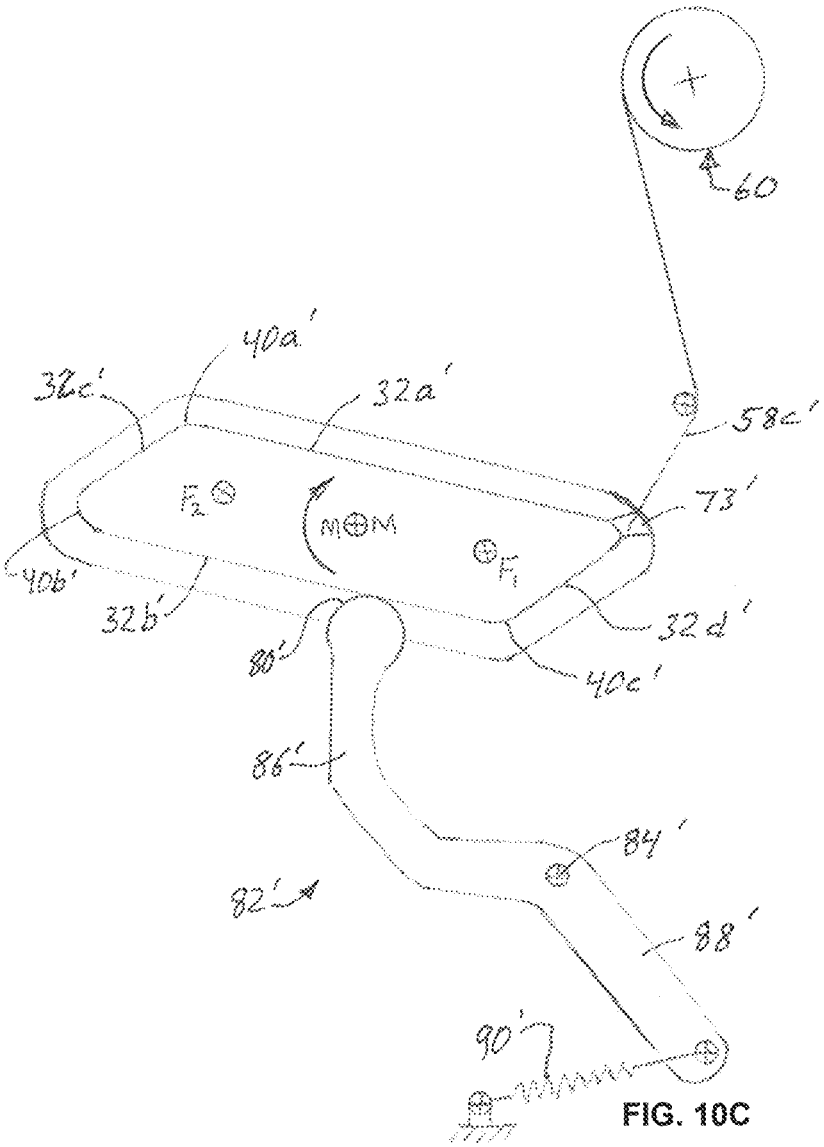
FIG. 10C is a schematic view of a winding mandrel and follower of FIG. 10A in a third position.
Figure 10D:
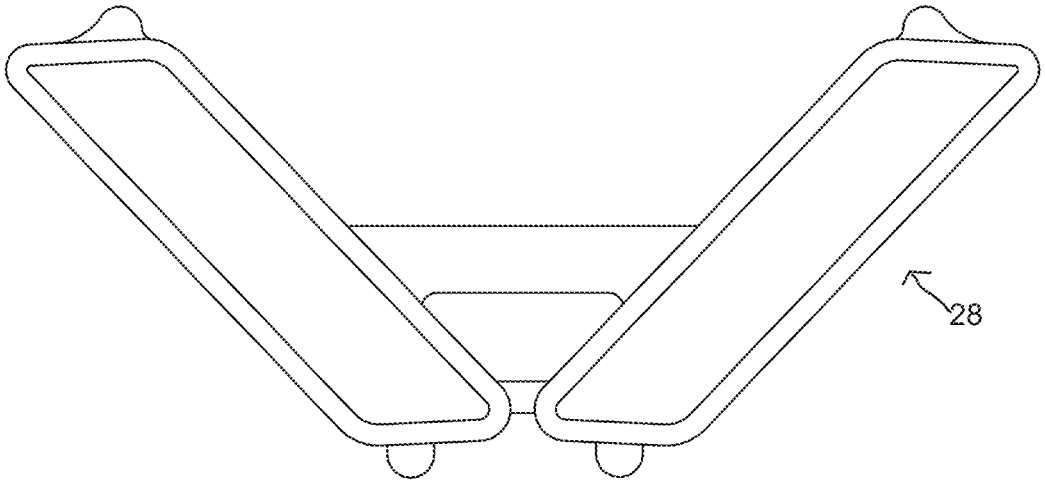
FIG. 10D is a photograph of a V-shaped tie shear according to an illustrative embodiment.
Figure 11:
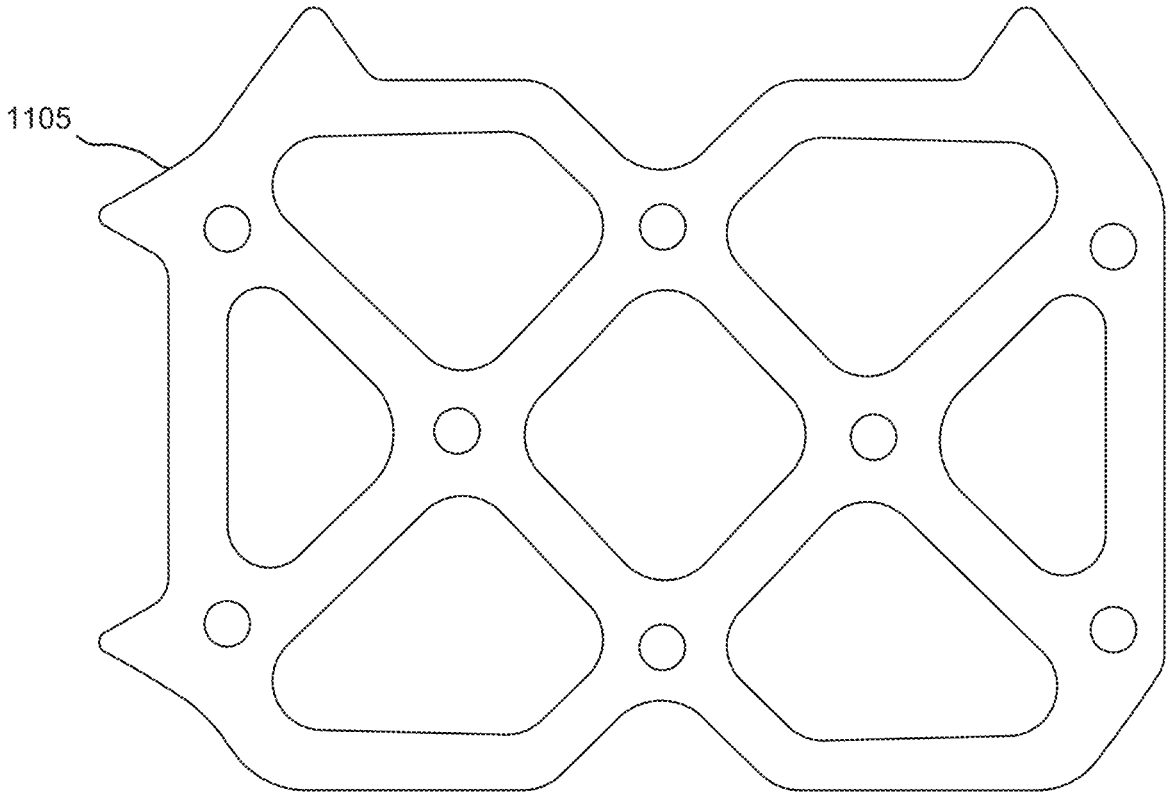
FIG. 11 is a drawing of a conventional shear tie connector sold by the owner or licensee of U.S. Pat. Nos. 6,088,985 and 6,761,007.

FIGS. 10A, 10B, and 10C show a mandrel 32 configured to form connector loop 32 in its use orientation, with that mandrel in different rotational positions. In order to help maintain the flatness of the rectangular-cross-section and more critically, maintain the preferred fiber-to-resin density ratio(s) of the wetted and wiped strands 58*c* as they are wound into a stack to form the connector loops 30, 32 a follower 80 is advantageously resiliently urged against the exterior side of each strand 58*c* as the strand is wound to urge each strand 58*c* toward the mandrel 70 and any intervening fibers 58*c* at the location where the follower 80 abuts the strand 58*c* as it is wound around the mandrel. The description is given for only one mandrel configuration, that of a mandrel configured to form second shear tie connector loop 32. The same nomenclature of adding a prime mark (') is used for the respective sides of the mandrel and fender if several mandrels or fenders are ganged together and that prime mark is used in the figures to further illustrate that the mandrels and other parts may be ganged together with either a single continuous strand 58*c* used, or with multiple strands 58*c*' from dedicated spool 60' used to wind the illustrated connector loop 32'.

The follower 80 will translate and/or rotate relative to the rotational axis M-M of the mandrel as the abutting surface of mandrel 70' is not a constant distance from the rotational axis M-M of the mandrel and is not a constant distance from the mandrel sides 32*a*, 32*b*, 32*c* and 32*d* and corners 40*a*, 40*b*, 40*c* and 40*d* about which the strands 58*c* are wrapped. If the mandrel 70 is the first mandrel in a gang of mandrels, then the mandrel 70' sides are sides 32*a*', 32*b*', 32*c*' and 32*d*', and the corners are 40*a*', 40*b*, 40*c*' and 40*d*'—as labeled in FIGS. 10A-10C.

The follower 80 is shown as a curved surface, and preferably a round surface, on a distal end of lever 82 which rotates back and forth about pivot 84 as the mandrel 70 rotates. A first, contacting end of the lever 82 has a C-shaped lever section 86 which is curved to allow clearance of the rotating mandrel 70, especially around corners 38*a*', 38*b*', 38*c*' and 38*d*' of the mandrel. A second, tension end 88 of the lever 82 located opposite C-shaped lever section 86 is connected to a resilient member 90 such as a coil spring 90 which is located and configured to urge the follower 80 against the sides 30 and corners 38 of the mandrel. As depicted, the spring 90 is attached to a second distal of the lever 82 to rotate the lever 82 about pivot 84 and resiliently urge the follower 80 at the first end of the lever, toward the mandrel 70 to compress the wet and wiped strands 58*c* against the mandrel sides 30 and corners 38 as the mandrel rotates.

Other configurations of the follower 82 may be used, and more than one follower may be used on the same mandrel to follow the wet and wiped strands 58*c* about only a portion of the mandrel. For example, the two followers 82 may be used to compress the strands 58*c* along a substantial length of the elongated sides 32*a*, 32*b* with the followers disengaging along the respective curved corners 40*a*, 40*b*, 40*c* or 40*d* on opposing ends of the respective sides.

The follower 80 is preferably made of stainless steel or other material that does not adhere to the binder 43 on the wetted and wiped strand 58*c* during winding. The sliding contact of achieved by pulling the wetted and wiped strand 58*c* beneath the relatively stationary curved follower 80 helps wipe the binder off the follower to reduce accumulation of binder on the follower.

The follower 80 is advantageously located to contact the wetted and wiped strand 58*c* when or shortly after that strand contacts the mandrel 70. The follower 80 is thus located so it can be placed adjacent the mandrel 70 and the base of the notch or slot 72, and trace the wetted and wiped strand 58*c* as it is wrapped around the mandrel-advantageously exerting a constant force on the contacting portion of the strand 58*c*.

Advantages

A V-shear tie connector 28 is provided that may be used upright (i.e., V-orientation with narrow end down during formation of first concrete layer) or inverted (i.e., cone or funnel orientation with narrow end up during formation of first concrete panel, as seen in FIGS. 3-5, in either orientation, the V-shaped shear tie connector 28 extends through the insulation layer 26. The V-shaped shear tie connector design is compact, compatible with additional steel reinforcements, and has high composite shear strength due in part to the high fiber density (high ratio of fibers-to-resin), especially if a continuously wound single strand is used or a plurality of strands each wrapped multiple times around the sides and ends of each loop 30, 32.

The strands 42 extending along the length of the short ends 30*c*, 30*d*, 32*c*, 32*d* are preferably parallel to the midline of the concrete layers or wythes 22, 24 and are fully embedded therein so the concrete layers 22, 24 transfer load from the panel 20 to the strands by placing the strands 42 in tension. The V-shaped configuration places two of the short ends spaced a larger distance apart than in the conventional structures, thus distributing the loads over a larger area of the concrete.

Advantageously one or more elongated strands 42 are continuous wound around mandrel 70 (FIGS. 6, 7 and 9) configured in the desired shape of the first and second connector loops 30, 32, with the connector loops then connected together with a suitable binder, such as ester resin, preferably through gussets 34, 36 which hold the connector loops in the desired relative orientation for ease of handling during manufacture of the sandwiched concrete panels 20. Preferably, the first and second connector loops 30, 32 are sufficiently symmetric that a single mandrel may produce both connector loops 30, 32, with the resulting connector loop (e.g., loop 30) being rotated 180° about an in-plane axis perpendicular to axis A-A in Fig. to achieve the other connector loop (e.g., loop 32).

After formation of the connector loops 30, 32, the gusset(s) 34, 36 may then be connected to the first and second connector loops 30, 32, using suitable adhesives such as ester resin. Alternative connection methods may also be used, including thermal binding. The spacing or positioning tabs 48 may be connected to either or both of the short ends 30*c*, 30*d*, 32*c*, 32*d* before or after the gusset(s) are connected, such as gussets 32, 34.

The shear tie connector 28 transfers loads without dependance on the strength of the matrix 44, which is preferably an ester resin matrix enveloping strands 42 made of fiberglass fibers or carbon fibers. In the described embodiments, the binding matrix 44 serves primarily as a facilitating medium to maintain the initial shape of the shear tie connector 28 (and particularly the connector loops 30, 32) during manufacturing and assembly. The matrix 44 also provides handling and shipping strength to the shear tie connector 28, and provides initial positioning strength of the strands 42 in the connector loops 30, 32, while the concrete and insulation sandwich panel 20 is being manufactured. The fiberglass/carbon fiber material used in the strands 42 advantageously has a coefficient of thermal expansion nearly the same as the concrete and preferably small enough not to affect its use. Furthermore, the thermal conductivity of strands 42 made of fiberglass fiber or carbon fiber approaches zero-thus providing a low thermal conduction path between the first and second concrete layers/wythes 22, 24.

The use of open connector loops 30, 32 with no crossing strands 42 eliminates the inherent weakness of the conventional connectors discussed above that use multiple crossing strands of fiber. The connector loops 30, 32 thus provide increased tensile strength and stiffness over the conventional fiberglass connectors.

Further, the conventional fiberglass connectors wrapped the strands when dry, and only after wrapping into the desired configuration was the resin added. The preferred connector loops 30, 32 are wrapped with the strands already impregnated with resin, which allows the wrapping to squeeze out excess resin thereby increasing the fiber to resin density. This contrasts with the conventional structures that wound the fibers into shape and then placed them in a mold to which was added resin to form a loosely packed resin fiber matrix.

Still further, the connector loop 30, 32 are wrapped under tension sufficient to keep the wetted and wiped strands 58*c* straight during winding, and that tension under winding helps squeeze out excess resin further increasing the density of fibers to binding resin. This also differs significantly from the conventional structures, which wrapped dry strands and then wetted the wrappings.

Additionally, the connector loops 30, 32 are preferably wound with flat strands 58 having a generally rectangular shape that is maintained during winding by the tension exerted on the strand to avoid cupping, to form a plurality of flat strands wound on top of each other in a stack, thereby increasing the fiber density.

Further, the use of two separate connector loops 30, 32 allow great flexibility in the size, shape and relative angle of inclination of those connector loops, as the loop wrapping may be readily altered and the gusset 34 (or 36 etc.) may be join at any desired inclination. In contrast, the double bow-tie configuration of the conventional fiberglass connectors would require making a new mold for each different configuration and variation. There is thus provided a faster and less expensive way to alter the design of the shear tie connectors 28.

Still further, the use of a finger or ring 68 to move the wetted and wiped strands 58*c* from one mandrel to the next through slot/slot 73 allows the connector loops 30, 32 to be simultaneously formed and quickly formed as once a predetermined number of strands are wound on a first mandrel the finger 68 may automatically and immediately move the strands 58*c* to the next mandrel. Further, the number of strands wound may be easily varied, thus readily varying the strength and properties of the connector loops 30, 32 and shear tie connectors 28. Moreover, the strand 58*c* extending through the slot 73 in fender 72 connects two connector loops 30, 32, providing a fiber strand to strengthen the first gusset 34 holding the loops in position for manipulation during use.

The winding methods and materials used for the connector loops 30, 32 achieves a shear tie connector with greater strength in use by increasing the density (fiber-to-resin ratio) of the closed loop strands 30, 32, while providing a compact easy-to-use size. The strands are formed by winding around simplistically arranged mandrel(s) having a curvature selected to maintain fiber strength at the corners of the parallelogram-shaped loops 30, 32, especially the strands are wound around the mandrel(s) under tension.

When joined together, the two connector loops 30, 32 may form the entire load transferring portion of the shear tie connector 28, without the complex arrangement of crossing links or segments used in the double-bow-tie configuration of the conventional structures. The ability to achieve increased strength and load-carrying capacity with simpler configurations is believed to provide less expensive manufacturing of the connectors and to simplify their use.

The described shear tie connector 28 provides a shear tie using dense, tightly wound, superimposed load-resisting fibers 42 embedded in matrix 44, advantageously using two closed loops 30,32 which use tension to maintain the shape of the wetted and wiped strands 58*c* to achieve higher density of straight fibers in the matrix 44 compared to prior connectors made of fiber reinforced polymer connectors.

Moreover, the closed loop connectors 30, 32 advantageously have no intersecting structural connections introducing loads along the length of the straight segments such as the elongated sides (e.g., 32*a*, 32*b*) and short ends (e.g. 32*c*, 32*d*) of the preferred parallelogram shape which can deform the strands 42 in those straight segments out of line and cause those strands to transfer loads to the embedding resin or binder 43 of the matrix.

The tension winding of the flat, rectangular sectioned, wetted and wiped fibers 58*c* is advantageously machine controlled as to strand tension and rotation rate of the mandrel so the number of wound strands on the mandrel (and in a single connector loop), can be determined to improve the consistency and quality of the connector loops 30, 32. By timing the rotation rate of the ganged mandrels with the feed rate of the wetted and wiped fiber 42 and the number of strands wound on each mandrel the positioning finger or ring 58 can be programmed to be moved as the slot 73 in the fender 72 is adjacent the strand, allowing the strand to be moved from one mandrel to an immediately adjacent mandrel, thus allowing successive mandrels to be wound of consistent quality and in less time than the conventional molding methods used to make fiber reinforced connectors.

The winding of each loop 30, 32 separately allows the loops to be wound with a variety of strands to suit design needs, and further allows the loops to be positioned at a variety of angles relative to each other to meet design needs. Thus, the manufacturing allows great flexibility of tailoring the strength and configurations of the shear tie connectors 28.

Moreover, the ability to add one or more gussets 36, 38 to hold the loops 30, 32 relative to each other allows a sturdier connectors 28 to be fabricated for heavy duty use, while reducing costs for connectors using a single gusset 36 at the narrow end of the V-shaped connector which single gusset is believed suitable for a majority of uses. For the smaller embodiments, the exterior corners corresponding to adjacent corners 38*b*, 40*b* are advantageously about 5/16 inch apart but joined by gusset 36 molded to join the connector loops and maintain them planar during installation.

Using the same resin as in the binder 43 to form the gussets 36, 38 joining the connector loops 30, 32 also allows forming various positioning tabs, support chairs or projections configured to support various items relative to the connector 28 which are to be entrained in the concrete. Advantageously, at least the connector. loops 30, 32 have substantially the same thickness measured along an axis orthogonal to the flat plane in which the loops 30, 32 lie when ready for use. Substantially the same thickness allows for manufacturing tolerances and do not exceed plus or minus 10% and advantageously plus or minus 5%. Preferably, the connector loops 30, 32, gussets 34, 36, positioning tabs 48, support chairs and other projections have the same thickness so the connector 28 is a uniform thinness to minimize the width of the slot or gap 46 between strips of insulation 52. There is thus provided a thin, strong shear tie connector with the above-described advantages.

The use of stronger and thinner shear tie connectors 28 allows fewer connectors to be used, thus reducing installation time and costs while maintaining the same connection strength, or allowing stronger connections for the same number of connectors in each concrete sandwiched panel 20.

Figure 12A:
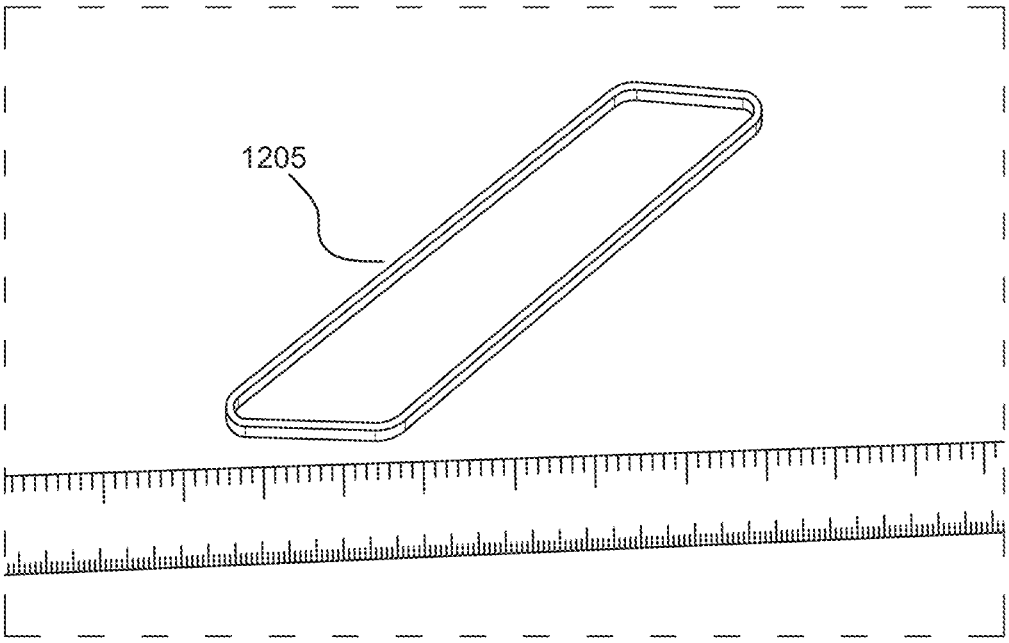
FIG. 12A is a schematic view of individual sliced loop cut from a billet according to an illustrative embodiment.

FIG. 12A is a schematic view of individual sliced loop cut 1205 from a billet according to an illustrative embodiment. A ruler is also shown to show an example of the size in his particular example.

Figure 12B:
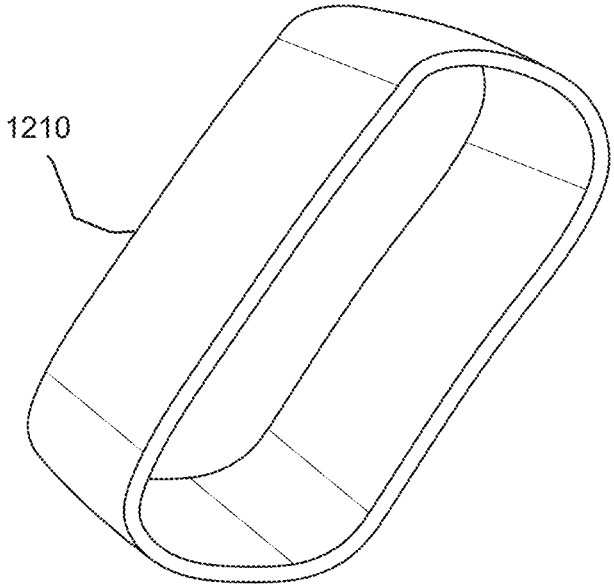
FIG. 12B is a schematic view of the completed wound fiber "billet" of "L-length".

FIG. 12B is a schematic view of a staged/spaced completed wound fiber "billet" of "L-length. Here it can be seen the wound fiber billet 1210 is thicker than the sliced loop 1205 of FIG. 12A.

The components, operations, steps, features, objects, benefits, and advantages that have been discussed herein are merely illustrative. None of them, nor the discussions relating to them, are intended to limit the scope of protection. While various advantages have been discussed herein, it will be understood that not all embodiments necessarily include all advantages. Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

Numerous other embodiments of the disclosure are also contemplated. There are also embodiments of the disclosure in which the components and/or operations are arranged and/or ordered differently than described and shown herein.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any such actual relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

What is claimed is:

1. A shear tie connector for use with a concrete and insulation composite panel, the shear tie connector comprising:

two structural shear-resisting parts forming a first connector loop and a second connector loop, each of the first connector loop and the second connector loop having a closed-loop parallelogram shape;

the two structural shear-resisting parts comprising a plurality of wetted and wiped fiber strands wound about a mandrel to form the first connector loop and the second connector loop, each having the closed-loop parallelogram shape comprising a plurality of fiber-strand layers with each fiber-strand having a width and a height, and the plurality of fiber strand layers forming a stack of layers into a parallelogram configuration, the fiber strands comprised of graphite tow, synthetic polymer yarn, and fiberglass material suitable for use in an insulated structural concrete panel;

the first connector loop and the second connector loop each comprising thermally non-conductive fibers in a binder to form a matrix, each of the first connector loop and the second connector loop having first and second opposing elongated sides and parallel sides, and first and second opposing and parallel short ends, the first connector loop and the second connector loop further having curved corners comprising first and second acute curved angles at two first opposing corners and first and second obtuse curved angles at two second opposing corners;

two non-structural shape-retaining gussets formed of resin, the first connector loop and the second connector loop joined by the gussets extending between the first connector loop and the second connector loop; and a plurality of stand-off positioning tabs attached to ends of the first connector loop and the second connector loop, respectively, the plurality of stand-off positioning tabs sized to facilitate arrangement of the shear tie connector in the concrete and composite insulation panel;

wherein the first connector loop and the second connector loop are inclined relative to each other in the same plane in a V-configuration with the first connector loop and the second connector loop being mirror images of each other about an axis of symmetry located between the first and second connector loops.

2. The shear tie connector of claim 1, wherein the first and second acute curved angles at two first opposing corners of the first connector loop and the second connector loop are adjacent each other; and wherein the gusset connects the first connector loop and the second connector loop at the two first opposing corners having the first and second acute angled corners.

3. The shear tie connector of claim 1, wherein the first and second acute curved angles of the two first opposing corners has a curvature of about 0.4 to 0.6 inches.

4. The shear tie connector of claim 3, wherein the first connector loop and the second connector loop have an interior facing edge and an opposing exterior facing edge, the interior facing edges of the elongated sides and the first and second opposing and parallel short ends being straight between the acute curved angles of the two first opposing corners and the exterior facing edges being curved outward between the two first opposing corners at a distance of less than about 0.2 inches.

5. The shear tie connector of claim 1, wherein the first and second opposing and parallel short ends of each of the first connector loop and the second connector loop is angled relative to the elongated side at an angle of 45° to 60°.

6. The shear tie connector of claim 1, wherein the first connector loop and the second connector loop are inclined relative to each other at an angle of 45° to 60°.

7. The shear tie connector of claim 1, wherein the fiber strands comprise one of: (i) graphite fibers in a resin binder; or (ii) fiberglass or synthetic polymer in the resin binder.

8. The shear tie connector of claim 1, wherein the fiber strands are straight along a length of substantially 95% of the length of the elongated sides and short ends of the first connector loop and the second connector loop as measured between the ends of the curved corners on opposing ends of each length.

9. The shear tie connector of claim 1, wherein the fiber strands comprise a single, continuous strand forming a plurality of circuits extending sequentially about a periphery of one of the first connector loop or the second connector loop, and overlaying an immediately prior circuit and being overlaid by a next following circuit.

10. The shear tie connector of claim 9, wherein the continuous strand has a rectangular cross section with a thickness smaller than the width, and a thickness of each strand substantially overlaying the strand below it and being overlaid by the strand above it to form a stack of overlaid strands which stack forms a width of the first connector loop or the second connector loop.

11. The shear tie connector of claim 1, wherein the first and second elongated sides and short ends of the first connector loop and the second connector loop each have a rectangular cross-section having a connector-thickness and a connector width, the connector-thickness corresponding to the width of a wetted and wiped fiber strands measured orthogonal to a plane, which connector-thickness is smaller than a connector-width, and wherein the connector width comprises a plurality of the wetted and wiped fiber strands each having a rectangular cross section with a strand-width of the wetted and wiped strands corresponding to the connector-thickness.

12. The shear tie connector of claim 1, wherein each of the first connector loop and the second connector loop comprises a plurality of rectangular wetted and fiber wiped strands having a width and a thickness and stacked on top of each other in the thickness direction to form a width of the first and second connector loop measured in a plane, with the width of the wetted and wiped strands corresponding to a thickness of the first and second connector loop measured orthogonal to the plane.

13. The shear tie connector of claim 1, wherein a density of fibers to binder in the matrix is at least 10% greater at each of the corners on opposing ends of one of the elongated sides, compared to the density of fibers to binder in the matrix at the middle of said one of the elongated sides.

14. The shear tie connector of claim 1, wherein a density of fibers to binder in the matrix is at least 10% greater at each of the corners on opposing ends of one of the short ends, compared to a density of fibers to binder in the matrix at the middle of said one of the short ends.

15. A tie shear connector for concrete wythes, comprising:

two shear-resisting closed loops configured in a strutless, substantially open, V-shaped formation;

at least two non-structural gussets having different lengths, the two non-structural gussets are arranged between the two shear-resisting closed loops to retain the two shear-resisting closed loops in the V-shaped formation at a predetermined angle; and a plurality of spacing tabs arranged along ends of the two shear-resisting loops above and below the two gussets;

wherein the tie shear connector is constructed of one or more thermally non-conductive materials.

16. The tie shear connector according to claim 15, wherein the strutless, substantially open V-shaped formation of the two shear-resisting closed loops are retained only via the at least two non-structural gussets.

17. The tie shear connector according to claim 15, wherein the two shear-resisting closed loops comprise two substantially parallelogram-shaped closed loops.

18. The tie shear connector according to claim 17, wherein the two substantially parallelogram-shaped closed loops are sized and shaped to enhance a load resisting capacity of concrete wythes based on a thickness and a cured concrete strength of the concrete wythes.

19. The tie shear connector according to claim 18, wherein the plurality of the spacing tabs comprises four spacing tabs, and the spacing tabs are arranged at longitudinal ends of the two substantially parallelogram-shaped closed loops, wherein the spacing tabs are non-structural spacing tabs comprised of resin.

20. The tie shear connector according to claim 18, wherein the two substantially parallelogram-shaped closed loops comprise a continuous fiber winding with resin-impregnated fiberglass or carbon fiber (FG/CF).

21. The tie shear connector according to claim 18, wherein an angle Z between the two substantially parallelogram-shaped closed loops ranges between 45 to 60 degrees when an X dimension ranges between 6 to 8 inches, and a Y direction ranges between 10-12 inches, wherein X dimensions are industry standards, and Y dimensions vary per industry convenience, with angle Z changing as Y changes.

22. The tie shear connector according to claim 18, wherein an angle Z between the two substantially parallelogram-shaped closed loops ranges between 55 to 60 degrees when an X dimension ranges between 10 inches to 12 inches, and a Y dimension is 15 inches.

* * * * *